United States Patent [19]

Tomisawa et al.

[11] 4,122,743

[45] Oct. 31, 1978

[54] ELECTRONIC MUSICAL INSTRUMENT WITH GLIDE

[75] Inventors: Norio Tomisawa, Hamamatsu; Yasuji Uchiyama, Hamakita; Takatoshi Okumura, Hamamatsu; Toshio Takeda, Hamamatsu, all of Japan

[73] Assignee: Nippon Gakki Seizo Kabushiki Kaisha, Hamamatsu, Japan

[21] Appl. No.: 823,236

[22] Filed: Aug. 9, 1977

Related U.S. Application Data

[63] Continuation of Ser. No. 581,180, May 27, 1975, abandoned.

[30] Foreign Application Priority Data

May 31, 1974 [JP] Japan ..... 49-61712
May 31, 1974 [JP] Japan ..... 49-61713

[51] Int. Cl.[2] ..... G10H 1/02
[52] U.S. Cl. ..... 84/1.24
[58] Field of Search ..... 84/1.01, 1.03, 1.13, 84/1.24, 1.25

[56] References Cited

U.S. PATENT DOCUMENTS 3,854,366 12/1974 Deutsch ..... 84/1.24
3,929,053 12/1975 Deutsch ..... 84/1.24

*Primary Examiner*—Robert K. Schaefer
*Assistant Examiner*—Vit W. Miska
*Attorney, Agent, or Firm*—Ladas, Parry, Von Gehr, Goldsmith & Deschamps

[57] ABSTRACT

In a digital type electronic musical instrument, a glide effect is produced by digitally frequency-modulating the frequency of a musical tone in such a manner that the frequency changes quickly and smoothly. Glide information used for effecting this frequency-modulation is produced on the basis of a glide code obtained by counting a clock pulse. The glide information which changes its contents uniformly is multiplied with the basic frequency information to effect the frequency-modulation. The glide effect can be controlled for each individual keyboard. According to an embodiment of the invention, the frequency-modulation is applied to an attack portion of a musical tone only and sustain and decay portions of the musical tone are reproduced with a normal frequency so that the musical tone will be provided with a crisp, vivid musical effect.

8 Claims, 16 Drawing Figures

MULTIPLIER
INFORMATION GENERATOR
FREQUENCY INFORMATION MEMORY
SAMPLE AND HOLD CIRCUIT
SAMPLE AND HOLD CIRCUIT
SR1
Sy1
Sy6
Sy25
Sy25
Sy2. Sy3.--- Sy6.---- Sy25. Sy1
OR4
OR5
OR6
OR18
A21
A22
A34
A35
A36
A48
Fm1
Fm2
Fm14
Cl1
Cl2
Cl14
Vx1
Vx2
Vx3
Vx10
Vx11
F1
F2
F3
F13
F14
V1
V2
V3
V4
V5
V6
GL
N1
N2
N3
N4
B1
B2
9a
9b
10
11
12a
12b
13
14
15
16
I3
Is

ELECTRONIC MUSICAL INSTRUMENT WITH GLIDE

This is a continuation, division, of application Ser. No. 581,180 filed May 27, 1975 now abandoned.

SUMMARY OF THE INVENTION

This invention relates to an electronic musical instrument and, more particularly, to a digital type electronic musical instrument capable of producing glide and similar effects, i.e. producing a musical tone frequency of which continuously changes during reproduction.

A digital type electronic musical instrument which produces a musical tone by digitally processing a signal generated upon depression of a key has many advantages over an analog type electronic musical instrument particularly in compactness in size and superior tone quality. It is not long, however, since the digital type electronic musical instrument came into being and there has not been instrument of this type capable of providing a reproduced musical tone with glide and similar effects obtainable from natural musical instruments.

The "glide effect" used herein signifies a special musical effect which is peculiar to slur and obtainable by continuously and gradually changing the frequency of a musical tone. The glide effect is sometimes needed in an electronic musical instrument if simulation of a whining tone resulting from a sliding steel bar on a guitar used in performing a Hawaiian music is wanted.

If the frequency of a musical tone is continuously changed in its rise portion only and the frequency proper to that particular tone is maintained in its sustain and decay states, the musical tone is accompanied by a crisp, lively sensation. This unique effect is hereinafter referred to as "accent effect."

It is an object of this invention to provide an electronic musical instrument capable of producing a glide effect with a compact and low-cost construction which can be composed of an integrated circuit.

It is another object of the invention to provide an electronic musical instrument capable of controlling the glide effect individually for each keyboard.

It is another object of the invention to provide an electronic musical instrument capable of producing an accent effect.

It is still another object of the invention to provide an electronic musical instrument capable of controlling the accent effect individually for each keyboard.

These and other objects and features of the invention will become apparent from the description made hereinbelow with reference to the accompanying drawings.

DESCRIPTION OF THE PREFERRED EMBODIMENTS

I. General Construction

Figure 1:
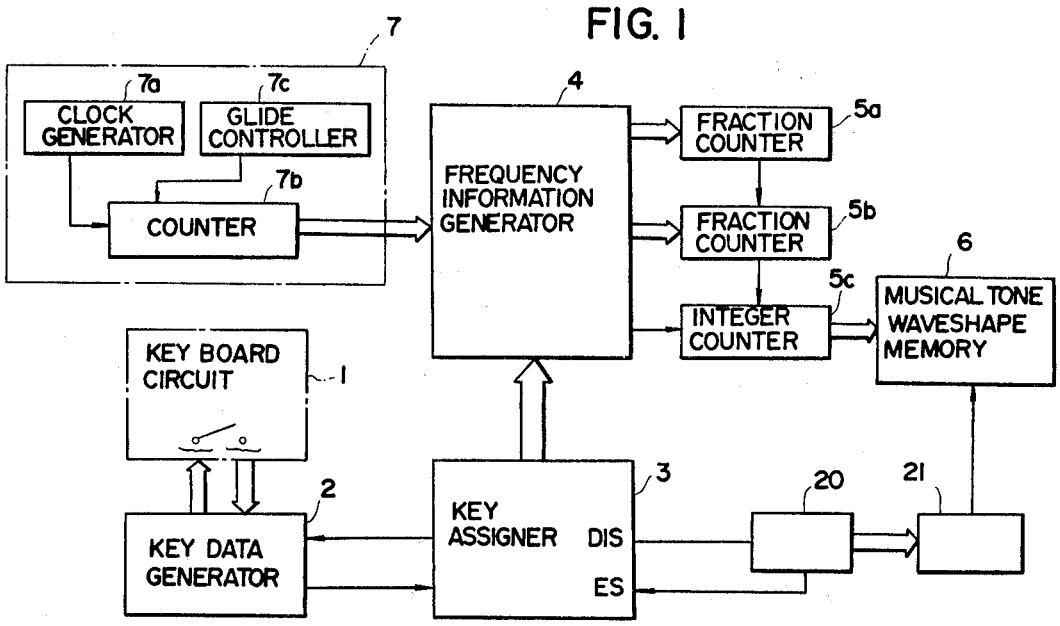
FIG. 1 is a block diagram showing one preferred embodiment of the electronic musical instrument according to the invention.

Referring first to FIG. 1 which shows one preferred embodiment of the electronic musical instrument according to the present invention, a keyboard circuit 1 has make contacts corresponding to respective keys. A key data signal generator 2 comprises a key address code generator which produces key address codes indicative of the notes corresponding to the respective keys successively and repeatedly. The key data signal generator 2 produces a key data signal when a make contact corresponding tp a depressed key is closed and the key address code corresponding to the depressed key is produced. This key data signal is applied to a key assigner 3. The key assigner 3 comprises a key address generator which operates in synchronization with the above described key address code generator, a key address code memory which is capable of storing a plurality of key address codes and successively and repeatedly outputting these key address codes and a logical circuit which, upon receipt of the key data signal, applies the key data signal to the key address code memory for causing it to store the corresponding key address code on the condition that this particular key address code as not been stored in any channel of the memory yet and that one of the channels of the memory is available for storing this key address code.

A frequency information generator 4 comprises a frequency information memory which stores frequency information corresponding to the respective key address codes (hereinafter referred to as "basic frequency information"), and glide information generator. The frequency information memory, upon receipt of a key address code from the key assigner 3, produces basic frequency information corresponding to the key address code. The glide information generator produces glide information in the form of a function upon receipt of a glide code from a glide code generator 7. The frequency information generator 4 further comprises a device for generating frequency information provided with a glide effect by frequency-modulating the basic frequency information by this glide information. The frequency-modulated frequency information consists of binary data having a fraction section and an integer section as will be described in detail later, the fraction section being applied to fraction counters 5*a* and 5*b* and the integer section to an integer counter 5*c*.

The glide code generator 7 is manually operated by a glide switch and counts a clock pulse during a predetermined period of time, supplying the counting output to the frequency information generator 4 as the glide code. The glide code generator 7 comprises a clock generator generating the clock pulse, a counter 7*b* for counting this clock pulse and a glide controller 7*c* for controlling the counting operation of the counter 7*b* to perform counting only during said predetermined period of time. A musical tone provided with the glide effect is produced only during this period of time as will be described later.

The fraction counter 5*a* is provided for cumulatively counting its inputs and applying a carry signal to the next fraction counter 5*b* when a carry takes place in the addition. The fraction counter 5*b* is of a like construction, applying a carry signal to the integer counter 5*c* when a carry takes place in the counter 5*b*.

The integer counter 5*c* cumulatively counts the carry signals and integer section information inputs and successively delivers out signals representing the results of the addition. The output signals of the integer counter 5*c* are applied to a plurality of input terminals of a waveshape memory 6. A musical tone waveshape for one period is sampled at $n$ points and the amplitudes of the sampled waveshape are stored at addresses 0 to $n-1$ of the waveshape memory 6. The musical tone waveshape is read from the waveshape memory 6 by successively reading out the amplitudes at the addresses corresponding to the output of the integer counter 5*c*.

The entire level of the waveshape signal read from the waveshape memory 6 is controlled by an envelope waveshape signal provided by an envelope memory 21. The envelope memory 21 stores a waveshape corresponding to an envelope formed during a period of time from the start of reproduction of a musical tone till the stop thereof. The envelope memory 21 is constructed in a similar mannner to the waveshape memory 6 and the amplitudes at the addresses corresponding to the outputs of an envelope counter 20 are successively read out. The counting in the envelope counter 20 is controlled by signals ES and DIS provided by the key assigner 3 and respectively representing depression and release of a key.

For achieving the purpose of reproducing plurality of musical tones simultaneously, the present electronic musical instrument has a construction based on dynamic logic so that the counters, logical circuits and memories provided therein are used in a time-sharing manner. Accordingly, time relations between clock pulses controlling the operations of these counters etc. are very important factors for the operation of the present electronic musical instrument.

Figure 2:
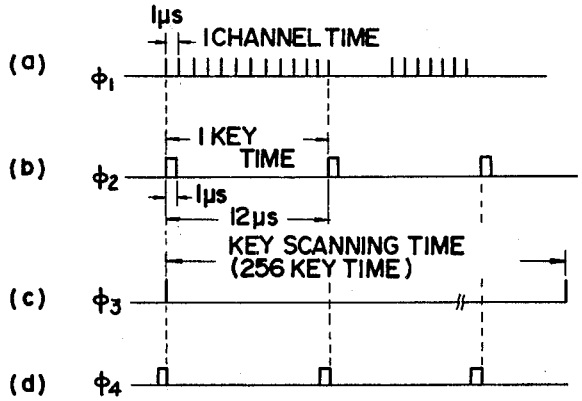
FIGS. 2(*a*) through 2(*d*) are respectively charts showing clock pulses employed in this embodiment of the electronic musical instrument.

Assuming that a maximum number of musical tones to be reproduced simultaneously is twelve, relations between the various clock pulses used in the present electronic musical instrument are illustrated in FIGS. 2(*a*) to 2(*d*). FIG. 2(*a*) shows a main clock pulse $\phi_1$ which has a pulse period of 1 $\mu$s. This pulse period is hereinafter referred to as a "channel time." FIG. 2(*b*) shows a clock pulse $\phi_2$ having a pulse width of 1 $\mu$s and a pulse period of 12 $\mu$s. This pulse period of 12 $\mu$s is hereinafter referred to as "key time." FIG. 2(*c*) shows a key scanning clock pulse $\phi_3$ which has a pulse period equivalent to 256 key times. One key time is divided by 12 $\mu$s and each fraction of the divided key time is called first, second . . . twelfth channel respectively. FIG. 2(*d*) shows a clock pulse $\phi_4$ which appears only during the twelfth channel in each key time. A channel denotes in this specification a shared portion of time, i.e. the channel time.

II. Generation of key address codes

Figure 3:
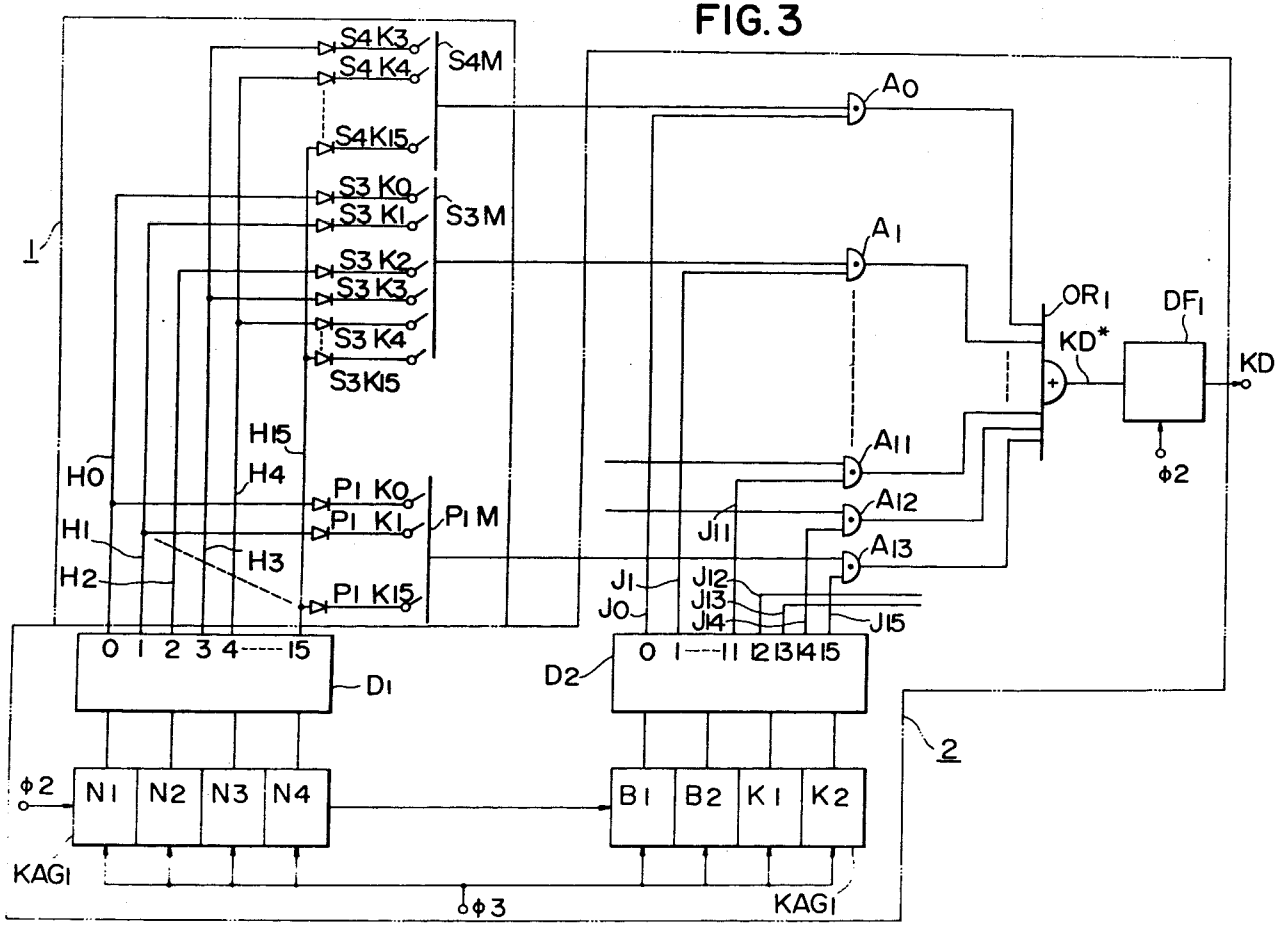
FIG. 3 is a circuit diagram showing a detailed logical circuit of a key data signal generator 2, shown in FIG. 2.

FIG. 3 shows the construction of the key data generator 2 in detail. A key address code generator $KAG_1$ consists of binary counters of eight stages. The clock pulse $\phi_2$ with the pulse period of 12 $\mu$s (hereinafter called a key clock pulse) is applied to the input of the key address code generator $KAG_1$. The key clock pulse applied to the key address code generator $KAG_1$ changes the code, i.e., the combination of 1 and 0 in each of the binary counter stages.

The highest class of electronic musical instrument typically has a solo keyboard, upper and lower keyboards and a pedal keyboard. The pedal keyboard has 32 keys ranging from $C_2$ to $C_4$ and the other keyboards respectively have 61 keys ranging from $C_2$ to $C_7$. Thus, this type of electronic musical instrument has 215 keys in all.

According to the present invention 256 different codes are produced by the key address code generator $KAG_1$ and 215 codes among them are alloted to the corresponding number of keys. Digits of the key address code generator $KAG_1$ from the least significant digit up to the most significant digit are represented by reference characters $N_1$, $N_2$, $N_3$, $N_4$, $B_1$, $B_2$, $K_1$ and $K_2$ respectively. Among them, $K_2$ and $K_1$ constitute a keyboard code representing the kind of keyboard, $B_2$ and $B_1$ a block code representing a block in the keyboard and $N_1$ through $N_4$ a note code representing a musical note in the block. Each keyboard is divided into four blocks each including 16 keys. These blocks are designated as block 1, block 2, block 3 and block 4 counting from the lowest note side. It is assumed that the key address codes which would correspond to three notes above the actually existing highest key (note $C_6$ of block 4) in the solo keyboard S, upper keyboard U and lower keyboard L and the key address codes which would correspond to the blocks 3 and 4 in the pedal keyboard are not alloted to keys in the present embodiment.

The bit outputs of the key address code generator $KAG_1$ are applied through decoders to the keyboard circuit for sequentially scanning each key. The scanning starts from the block 4 of the solo keyboard S and is performed through the blocks 3, 2. 1 of the solo keyboard S, the blocks 4, 3, 2, 1 of the upper keyboard U, the blocks 4, 3, 2, 1 of the lower keyboard L and the blocks 2, 1 of the pedal keyboard P. One cycle of scanning of all of the keys is thereby completed and this scanning operation is cyclically repeated at an extremely high speed. Scanning time required for one cycle of scanning is $256 \times 12\ \mu s = 3.07$ ms.

Decoder $D_1$ is a conventional binary-to-one decoder designed to receive four-digit binary codes consisting of combinations of the digits $N_1$ to $N_4$ of the key address code generator $KAG_1$ and to deliver an output at one of the sixteen individual output lines $H_O$ through $H_{15}$ successively and sequentially, the binary code in each instance determining a respective output line. The output line $H_O$ is connected through diodes to the key switches corresponding respectively to the highest note of each block (except the blocks 4) of the respective keyboards. The output line $H_1$ is similarly connected to the key switches corresponding to the second highest note of each block except the blocks 4. It will be understood that no keys are provided for the three codes on the highest note side in the block 4 of the solo keyboard S, the upper keyboard U and the lower keyboard L and, accordingly, the output lines $H_0$ to $H_2$ are not connected in the blocks 4. Output line $H_3$ and subsequent output lines are connected in a similar manner to the corresponding key switches of each block (also of block 4).

FIG. 3 illustrates connections between respective key switches and the output lines $H_0 - H_{15}$ with respect to the blocks 4 and 3 of the solo keyboard S and the block 1 of the pedal keyboard P. The first letter of the symbols used on the key switches designates the kind of the keyboard, the numeral affixed to the first letter the block number, and the numeral affixed to the letter K a decimal value of the corresponding one of the codes $N_1 - N_4$.

Each key switch has a make contact. One contact point thereof is individually connected as has been described above and the other contact point constitutes a common contact for each block. The common contacts $S_4M - P_1M$ are respectively connected to AND circuits $A_0 - A_{13}$.

Decoder $D_2$ is a conventional binary-to-one decoder designed to receive four-digit binary codes consisting of combinations of the digits $B_1$, $B_2$, $K_1$ and $K_2$ of the key address code generator $KAG_1$ and to deliver an output at one of the 16 individual output lines $J_0$ through $J_{15}$ successively and sequentially, the binary code in each instance determining a respective output line. The output lines $J_0$ through $J_{15}$ (except $J_{12}$ and $J_{13}$) are connected to the inputs of the AND circuits $Y_0$ through $Y_{13}$ respectively. The outputs of the AND circuits $Y_0$ through $Y_{13}$ are connected through OR circuit $OR_1$ to the input of a delay flip-flop circuit $DF_1$.

The codes produced from the key address code generator $KAG_1$ change their contents every time the key clock pulse $\phi_2$ is applied.

If a certain key is depressed, the make contact corresponding to the depressed key is closed. When the key address code generator $KAG_1$ provides a code which corresponds to the depressed key, an output "1" is produced from one of the AND circuits $A_0$–$A_{13}$. This output is provided via an OR circuit $OR_1$. This output is a key data signal KD* which represents the closing of the make contact. This signal is delayed by the delay flip-flop $DF_1$ by one key time and provided therefrom. The key data signals KD*, KD are sequentially output with an interval of 3.07 ms as long as the make contact remains closed.

The foregoing description has been made with regard to a case where only one key is depressed. If a plurality of keys are depressed simultaneously, key data signals respectively corresponding to the depressed keys are produced in the same manner and different musical tone waveshapes respectively corresponding to these key data signals are obtained. For convenience of explanation, description will be made hereinbelow about a case where only one key is depressed to obtain one musical tone waveshape.

Figure 4:
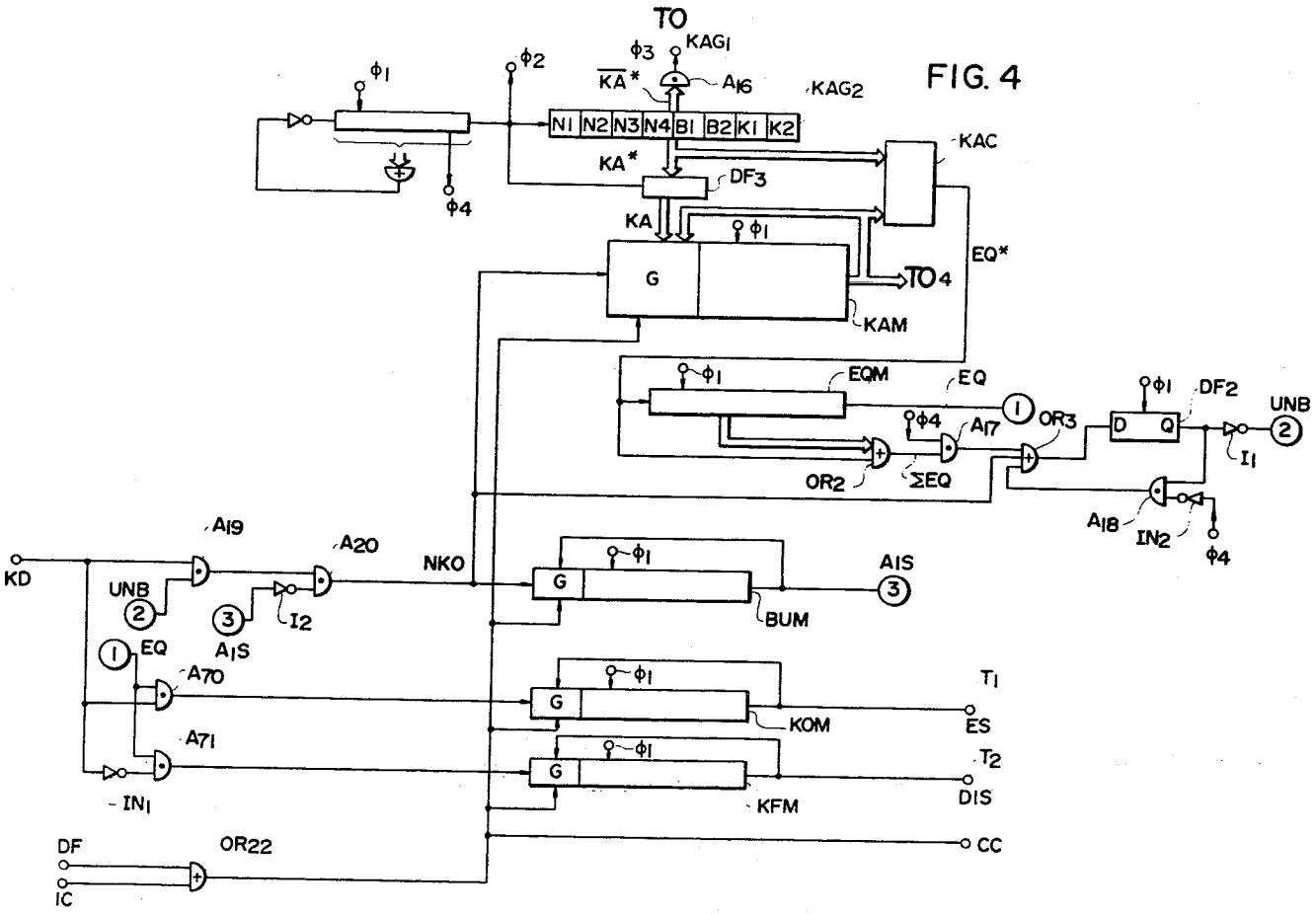
FIG. 4 is a circuit diagram showing a detailed logical circuit of a key assigner 3 shown in FIG. 1.

FIG. 4 is a block diagram showing the construction of the key assigner 3 in detail. A key address code memory KAM has memory channels of a number equal to that of the musical tones to be reproduced at the same time, each of these channels storing a key address code representing the musical note being played. The key address code memory KAM is adapted to apply the key address code in a time-sharing manner to the frequency information generator 4 as a frequency designation signal. In the present embodiment, a shift register of 12 words — 8 bits is utilized as the key address code memory KAM. This shaft register performs shifting upon receipt of the main clock pulse $\phi 1$ produced at an interval of 1 $\mu$s. The output from the last stage of this shift register is provided to the frequency information memory and, simultaneously, fed back to its input side. Accordingly, each key address code is circulated in the shift register at a cycle of 1 key time (12 $\mu$s) unless the code is cleared from its corresponding channel.

A key address code generator $KAG_2$ is of the same construction as the key address code generator $KAG_1$. These two generators $KAG_1$ and $KAG_2$ operate in exact synchronization with each other. More specifically, the key clock pulse $\phi_2$ is used as input signals to both of the generators $KAG_1$ and $KAG_2$ and the fact that the respective bits of the key address code generator $KAG_2$ are all "0" is detected by an AND circuit $A_{16}$ and the detected signal $\phi_3$ is applied to the reset terminals of the respective bits of the key address code generator $KAG_1$ as the key scanning clock signal. The key assigner 3 causes the key address code memory KAM to store a key address code corresponding to the key data signal KD upon receipt thereof when the following two conditions are satisfied:

Condition (A); The key address code is not identical with any of the codes already stored in the key address code memory KAM.

Condition (B); there is a not-busy channel, i.e. a channel in which no code is stored, in the key address code memory KAM.

Assume now that a key data signal KD* is produced from the OR circuit $OR_1$. At this time the key address code from the key address code generator $KAG_2$ coincides with the code of the key address code generator $KAG_1$ and represents the note of the depressed key. During the 12 $\mu$s period, the key address code KA* is applied to a comparison circuit KAC in which the code KA* is compared with each output of the channels of the key address code memory KAM. A coincidence signal EQ* produced from the comparison circuit KAC is "1" when there is coincidence and "0" when there is no coincidence. The coincidence signal EQ* is applied to a coincidence detection memory EQM and also to one input terminal of an OR circuit $OR_2$. This memory EQM is a shift register having a suitable number of bits, e.g. 12 as in this embodiment. The memory EQM successively shifts the signal EQ*, i.e. delays it by one key time when the signal EQ* is "1" and thereby produces a coincidence signal EQ (−1). Each of the outputs from the first to eleventh bits of the coincidence detection memory EQM is applied to the OR circuit $OR_2$. Accordingly, the OR circuit $OR_2$ produces an output when either the signal EQ* from the comparison circuit KAC or one of the outputs from the first to eleventh bits of the shift register EQM is "1." The output signal Σ EQ of the OR circuit $OR_2$ is applied to one of the input terminals of an AND circuit $A_{17}$. The AND circuit $A_{17}$ receives a clock pulse $\phi_4$ at the other input terminal thereof. Since information stored in the shift register before the first channel is false information, correct information, i.e. information representing the result of comparison between the key address code KA* and the codes in the respective channels of the key address code memory KAM is obtained only when the result of the comparison in each of the first to eleventh channels is applied to the coincidence detection memory EQM and the result of comparison in the twelfth channel is applied directly to the OR circuit $OR_2$. This is the reason why the clock pulse $\phi_4$ is applied to the AND circuit $A_{17}$.

If the signal Σ EQ is "1" when the clock pulse $\phi_4$ is applied, the AND circuit $A_{17}$ produces an output "1" which is applied through an OR circuit $OR_3$ to a delay flip-flop $DF_2$. The signal is delayed by this delay flip-flop $DF_2$ by one channel time and fed back thereto via an AND circuit $A_{18}$. Thus, the signal "1" is stored during one key time until a next clock pulse $\phi_4$ is applied to the AND circuit $A_{18}$ through an inverter $IN_2$. The output "1" of the delay flip-flop $DF_2$ is inverted by an inverter $I_1$ and is provided as an unblank signal UNB. This unblank signal UNB indicates that the same code as the key address code KA* is not stored in the key address code memory KAM when it is "1," and that the same code as the key address code KA* is stored in the memory KAM when it is "0."

As described in the foregoing, presence of the condition (A) is examined during production of the key data signal KD*. In other words, whether the key data signal is an old signal which has already been stored or a new one which has not been stored in the memory is examined. The unblank signal UNB which indicates the result of the examination is applied to one input terminal of an AND circuit $A_{19}$ during the next one key time. The key data signal KD is delayed by one key time and applied to the other input terminal of the AND circuit $A_{19}$. Accordingly, whether a key address code corresponding to the key data signal KD is stored in the memory KAM is examined by one key time immediately before the application of the key data signal KD. When the unblank signal UNB Is "1," the key data signal KD is applied to one of the input terminals of an AND circuit $A_{20}$ via the AND circuit $A_{19}$. When the unblank signal UNB is "0," the key data signal KD is not gated out of the AND circuit $A_{19}$.

In order for a new key address code to be stored in the key address code memory KAM, at least one of the twelve channels of the memory must be in a not-busy state, i.e. available for storage. A busy memory BUM is provided to detect whether there is a not-busy channel in the key address code memory. The busy memory BUM consists of a shift register of 12 bits, and is adapted to store "1" when a new key-on signal NKO is applied thereto from an AND circuit $A_{20}$. The signal "1" is sequentially and cyclicly shifted in the busy memory BUM. This new key-on signal is simultaneously applied to the key address code memory KAM so as to cause the memory KAM to store the new key address code. Accordingly, the signal "1" is stored in one of the channels of the busy memory BUM corresponding to the busy channel of the key address code memory KAM. Contents of a not-busy channel are "0." Thus, the output of the final stage of the busy memory BUM indicates whether this channel is busy or not. This output is hereinafter referred to as a busy signal AIS.

This busy signal AIS is applied to one of the input terminals of the AND circuit $A_{20}$ via an inverter $I_2$. When the signal AIS is "0," i.e., a certain channel is not busy, the key data signal is applied to the busy memory BUM as the new key-on signal via the AND circuit $A_{20}$ thereby causing the busy memory BUM to store "1" in its corresponding channel. Simultaneously, the gate G of the key address code memory KAM is controlled so that the key address code KA from a delay flip-flop $DF_3$ will be stored in a not-busy channel of the memory KAM.

The delay flip-flop $DF_3$ is provided for delaying the output KA* of the key address code generator KAG by one key time so that a key address code corresponding to the key data signal KD may be stored in synchronization with the key data signal KD, since the key data signal KD* which is delayed by one time is applied to the key assigner.

The new key-on signal NKO from the AND circuit $A_{20}$ is applied through the OR circuit $OR_3$ to the delay flip-flop $DF_2$ to set the flip-flop, and the unblank signal UNB becomes "0". Accordingly, the output of the AND circuit $A_{19}$ becomes "0" when the unblank signal UNB becomes "0" thereby changing the new key-on signal NKO to "0". This arrangement is provided to ensure storage of the key address code KA in only one, and not two or more, not-busy channel of the key address code memory KAM.

In this way, twelve kinds of key address codes are stored in the key address code memory KAM, and these address codes are shifted by the main clock pulse $\phi_1$ and the outputs of the final stage are successively applied to the frequency information generator 4 and also fed back to the input side of the memory KAM for cyclically producing outputs therefrom, changing at a rate of 1 μs, i.e. the same code appearing once every 12 μs.

It should be noted that the key address codes $N_1 - B_2$ representing the notes are applied to the frequency information memory and the key address codes $K_1$, $K_2$ representing the keyboards are utilized as desired for controlling a musical tone for each keyboard.

Assume now that a key address code has been stored in the first channel. If the key data signal KD is applied to one of the input terminals of an AND circuit $A_{70}$, a signal "1" is applied to the other input terminal of the AND circuit $A_{70}$, since "1" is already stored in the first channel of the coincidence memory EQM. Accordingly, the key data signal KD is gated out of the AND circuit $A_{70}$ only during the time corresponding to the first channel and stored in the first channel of the key-on memory KOM.

The storage of the signal "1" in the key-on memory KOM represents a stage in which the make contact of the key switch is closed (hereinafter referred to as "key-on").

The signal "1" of the first channel of the key-on memory KOM is also supplied to a terminal $T_1$ as an attack start signal ES. This attack start signal ES is continuously produced until the signal "1" of the first channel of the key-on memory KOM is reset as will be described later.

When the key is released, the key data signal ceases to be produced. This causes a signal "1" produced through an inverter IN, to be applied to one of the input terminals of an AND circuit $A_{71}$. The coincidence signal EQ is still being applied to the other input terminal of the AND circuit $A_{71}$. Accordingly, a signal "1" is stored in the first channel of a key-off memory KFM. The contents of the first channel are successively shifted in the key-off memory KFM and are output from the last stage thereof as a signal "1". This signal "1" which is applied to a terminal $T_2$ represents a key-off state and hereinafter is called a decay start signal DIS.

The contents of the memories of the key assigner 3 is cleared by applying to the input terminal of the OR circuit $OR_{22}$ a counting termination signal DF from an envelope counter 13 when reading of envelope waveshapes has been completed. The output of the OR circuit $OR_{22}$ is also utilized as a clear signal CC for clearing each counter. One input $I^C$ to the OR circuit $OR_{22}$ is an input for resetting the respective memories and counters to their initial conditions upon turning-on of the power.

III. Frequency Information Generator

Figure 5:
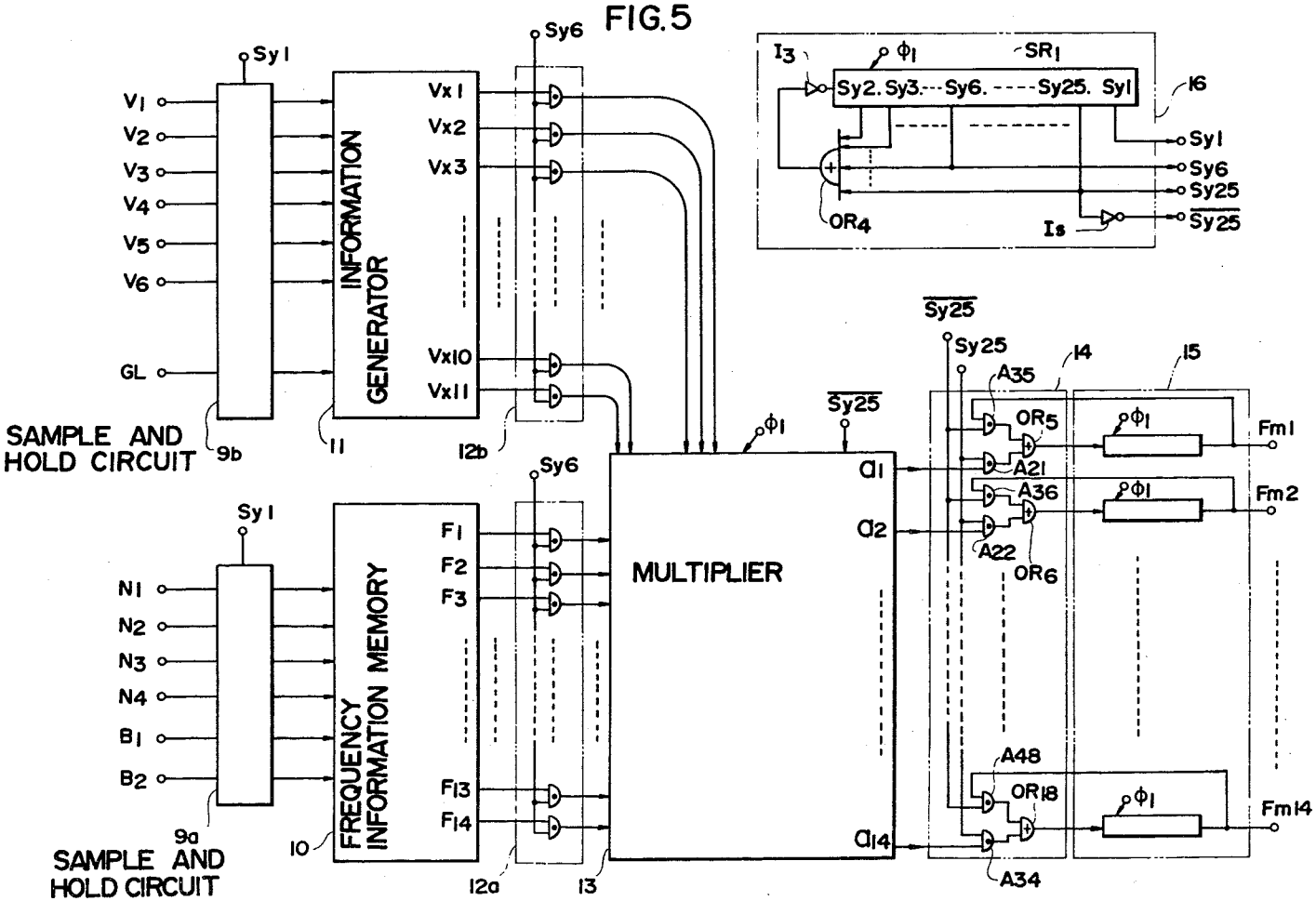
FIG. 5 is a block diagram showing in detail a frequency information generator 4 shown in FIG. 1.

FIG. 5 is a schematic block diagram showing the frequency information generator 4. The frequency information generator comprises the frequency information memory 10 and the glide information generator 11. Glide information $Vx_1 - V_{x11}$ is multiplied with the basic frequency information $F_1 - F_{14}$ in a multiplier 13 to effect frequency-modulation in a digital manner. An output shift register 15 is provided for outputting the result of the multiplication in a time sharing sequence manner.

The frequency information memory 10 stores information representing a plurality of predetermined frequencies corresponding to the respective key address codes and produces basic frequency information $F_1 - F_{14}$ for a particular key address code (a combination selected from $N_1$, $N_2$, $N_3$, $N_4$, $B_1$ and $B_2$) when this key address code is applied thereto.

The frequency information for each frequency consists of a suitable number of bits, e.g. 14 as in the present embodiment. One bit of the 14 bits represents an integer section and the rest of the bits, i.e. 13 represent a fraction section. The following Table I illustrates an example of the frequency information corresponding to keys $C_1$, $C_2$, $C_3$, $C_4$, $C_5$, $C_6$, $D_5$#and $E_5$.

If one key time is 12 $\mu$s, the number of times per second F is accumulated in the frequency counters 5a to 5c is $(1/12) \times 10^6$.

This frequency information F is stored in the memory 10 in correspondence to the frequency $f$ to be obtained and this constitutes the basic frequency information $F_1 - F_{14}$ as shown in Table I.

The glide information generator 11 produces glide information $V_{x1} - V_{x11}$ which is used for providing a musical tone to be reproduced with frequency which changes in steps during a predetermined period of time and thereby producing the glide effect. The amount of frequency change in each step is so small that the audience perceives it as a continous change. This frequency change is achieved by changing the value of the basic frequency information $F_1 - F_{14}$ gradually and in steps during a predetermined period of time. In order to produce such frequency change, the glide information $V_{x1} - V_{x11}$ is represented by a ratio to the basic frequency information $F_1 - F_{14}$. This ratio, i.e. the glide information, changes in relation to time in accordance with the address of a glide code $V_1 - V_6$ to be described later. The glide information $V_{XL} - V_{x11}$, accordingly, is expressed as a function with the glide code $V_1 - V_6$ being used as a variable. A glide control signal GL is a signal for controlling the glide information $V_{x1} - V_{x11}$ which is output from the glide information generator 11. The glide control signal GL is produced by manual operation of a glide switch. The function may either be one which gradually decreases from a higher frequency to the basic frequency or one which increases from a lower frequency to the basic frequency.

The glide information generator 11 may be constructed of any conventional device if it can produce the glide information $V_{x1} - V_{x11}$ in the form of the above described function. For example, the glide information generator 11 may comprise a memory which previously stores a predetermined function and the glide information $V_{x1} - V_{x11}$ may be read out in accordance with the address of the glide code $V_1 - V_6$ and the glide control signal GL.

Table I

| | Basic frequency information $F_1$-$F_{14}$ | | | | | | | | | | | | | | |
|---|---|---|---|---|---|---|---|---|---|---|---|---|---|---|---|
| | Integer Section | Fraction section | | | | | | | | | | | | | |
| Note | 14 | 13 | 12 | 11 | 10 | 9 | 8 | 7 | 6 | 5 | 4 | 3 | 2 | 1 | F-number |
| $C_1$ | 0 | 0 | 0 | 0 | 0 | 1 | 1 | 0 | 1 | 0 | 1 | 1 | 0 | 0 | 0.052325 |
| $C_2$ | 0 | 0 | 0 | 0 | 1 | 1 | 0 | 1 | 0 | 1 | 1 | 0 | 0 | 1 | 0.104650 |
| $C_3$ | 0 | 0 | 0 | 1 | 1 | 0 | 1 | 0 | 1 | 1 | 0 | 0 | 1 | 0 | 0.209300 |
| $C_4$ | 0 | 0 | 1 | 1 | 0 | 1 | 0 | 1 | 1 | 0 | 0 | 1 | 0 | 1 | 0.418600 |
| $C_5$ | 0 | 1 | 1 | 0 | 1 | 0 | 1 | 1 | 0 | 0 | 1 | 0 | 1 | 0 | 0.837200 |
| $D_5$# | 0 | 1 | 1 | 1 | 1 | 1 | 1 | 1 | 0 | 1 | 1 | 1 | 0 | 0 | 0.995600 |
| $E_5$ | 1 | 0 | 0 | 0 | 0 | 1 | 1 | 1 | 0 | 0 | 0 | 0 | 0 | 0 | 1.054808 |
| $C_6$ | 1 | 1 | 0 | 1 | 0 | 1 | 1 | 0 | 0 | 1 | 0 | 1 | 0 | 0 | 1.674400 |

In this table, the F-number represents the basic frequency information $F_1 - F_{14}$ expressed in a decimal notation, with the most significant digit $F_{14}$ being placed in the integer section.

The basic frequency information is determined in such a manner that it corresponds to a musical tone of a normal pitch without any glide effect being afforded thereto. Assume that the waveshape of the musical tone to be reproduced is stored at 64 sampled values at 64 sample points and the frequency is represented by $f$. The frequency information F is represented by the following equation:

$$F = f \times 64 \times 12 \times 10^{-8}$$

The multiplier 13 frequency-modulates the basic frequency information $F_1 - F_{14}$ digitally by multiplying the basic frequency information $F_1 - F_{14}$ with the glide information $V_{x1} - V_{x11}$ and thereby produces frequency information provided with the glide effect. A conventional digital type multiplier may be used as the multiplier 13. For example, the multiplier may comprise a multiplier shift register (not shown) which temporarily stores the glide information $V_{x1} - V_{x11}$ as multiplier and outputs a single numeral starting from the most significant digit in response to the main clock pulse $\phi_1$, a multiplicand shift register (not shown) which stores the basic frequency information $F_1 - F_{14}$ as multiplicand and produces parallel outputs while sequentially shifting the multiplicand from the less significant digit toward the more significant digit in response to the main clock pulse $\phi_1$, and a numeral multiplier (not shown) consisting of a logical circuit for multiplying the single numeral output from the multiplier shift register with the outputs of the multiplicand shift register. This numeral multiplier produces a product of the multiplier and the multiplicand by each single numeral. The multiplier 13 may further comprise an adder and an accumulating register (neither is shown). The products by each single numeral are added together by the adder to produce a partial product. This partial product is temporarily stored in the accumulating shift register. The addition of the product by each single numeral and the partial product is repeated to finally produce a total product $a_1 - a_{14}$. Further, the multiplier may comprise a delay flip-flop (not shown) which temporarily (for 1 $\mu$s) holds a carry signal to ensure carrying which takes place in the addition.

A digital type multiplier performs multiplication by repetition of addition and, if multiplier and multiplicand consist of many digits, time required for repetition of addition and carrying to complete a single multiplication must be taken into consideration. For achieving an accurate multiplication it is indispensable that time required for multiplication by synchronized with the operation of the entire system. According to the invention, a synchronization signal generation circuit 16 is provided for synchronization between the component parts of the frequency information generator 4.

The synchronization signal generation circuit 16 generates a synchronizing pulse Sy 1 used for synchronization between an input signal to the frequency information memory 10 and an input signal to the glide information generator 11, a synchronizing pulse Sy 6 used for synchronization between input signals to the multiplier 13 supplied from the frequency information memory 10 and the glide information generator 11, a synchronizing pulse Sy 25 used for outputting a result of multiplication from the multiplier 13 when the time required for multiplication has elapsed since application of an input thereto by means of the synchronizing pulse Sy 6 and a signal $\overline{\text{Sy}}$ 25 which is of an opposite polarity to the signal Sy 25 and used for clearing the multiplier 13.

In determining time interval between the synchronizing pulses Sy 1 and Sy 6, the operation time of the frequency information memory 10 and the glide information generator 11 is considered and, in determining time interval between the synchronizing pulses Sy 6 and Sy 25, the operation time of the multiplier 13 is considered. Assume now that a maximum number of musical tones to be reproduced simultaneously is 12. The synchronizing signal generation circuit 16 comprises a one-input-parallel-output type shift register $SR_1$ with 25 bits, an OR gate $OR_4$ receiving outputs of the first to the 24th bits of the shift register $SR_1$ and inverters $I_3$ and $I_5$. The contents in the shift register $SR_1$ are shifted by the clock pulse $\phi_1$ every 1 $\mu$s and the output from the 5th bit is used as the synchronizing pulse Sy 6, the one from the 24th bit as the synchronizing pulse Sy 25 and the one from the 25th bit as the synchronizing pulse Sy 1 respectively. Relationship between the respective pulses Sy 1, Sy 6, Sy 25, $\overline{\text{Sy}}$ 25 are illustrated in FIGS. 6(C) through 6(f). FIG. 6(a) shows the channel time.

A sample and hold circuit 9a holds key address code $N_1 - B_2$ in storage during one pulse period of the synchronizing pulse Sy 1 (i.e. 25 $\mu$s) and supplies the stored key address code to the frequency information memory 10 until application of a next pulse Sy 1. A sample hold circuit 9*b* likewise holds glide code $V_1 - V_6$ and the glide control signal GL in storage during one pulse period of the synchronizing pulse Sy 1 and supplies these signals to the glide information generator 11 until application of a next pulse Sy 1.

A first gate circuit 12*a* is composed of a plurality of AND circuits each of which receives, at one input thereof, a corresponding one of the bit outputs $F_1 - F_{14}$ of the frequency information memory 10 and, at the other input thereof, the synchronizing pulse Sy 6. A second gate circuit 12*b* is likewise composed of a plurality of AND circuits each of which receives at one input thereof a corresponding one of the bit outputs $V_{x1} - V_{x11}$ of the glide information generator 11. These gate circuits 12*a* and 12*b* supply, upon application thereto of the synchronizing pulse Sy 6, the frequency information $F_1 - F_{14}$ and the glide information $V_{x1} - V_{x11}$ to the multiplier 13 respectively as multiplicand inputs and multiplier inputs.

A third gate circuit 14 comprises AND circuits $A_{21} - A_{34}$ each of which receives at one input thereof a corresponding bit output of the multiplier 13 and at the other input thereof the synchronizing pulse Sy 25, AND circuits $A_{35} - A_{48}$ each of which receives at one input thereof a signal fed back from the final stage of corresponding shift register of the output shift register group 15 and, at the other input thereof, the signal $\overline{\text{Sy}}$ 25 which is of an opposite polarity to the synchronizing pulse Sy 25, and OR circuit $OR_5 - OR_{18}$ each of which receives the outputs of corresponding ones among the AND circuits $A_{21} - A_{34}$ and $A_{35} - A_{48}$. When the third gate circuit 14 receives the synchronizing pulse Sy 25, it applies signals $a_1 - a_{14}$ representing the results of the multiplication conducted in the multiplier 13 (i.e. frequency-modulated frequency information $F_{m1} - F_{m14}$) to the respective inputs of the shift registers of the output shift register group 15. When the synchronizing pulse Sy 25 is not applied to the third gate circuit 14, the output data of the shift register group 15 is circulated.

Each shift register of the output shift register group 15 has 12 words (each word consisting of 14 bits) and is successively shifted by the clock pulse $\phi_1$.

The results of the multiplication for each channel (i.e. each key or tone) conducted in the multiplier 13 are sequentially output therefrom with an interval of 25 $\phi$s per channel (i.e. one key or one tone). Accordingly, it takes 300 $\phi$s before the results of the multiplication for all of the 12 channels have been output from the multiplier 13. In other words, the results of the multiplication for the respective channels stored in the output shift register group 15 are rewritten by the outputs of the multiplier 13 every 300 $\phi$s. Furthermore, the output shift register group 15 sequentially supplies the results of the multiplication for the respective channels (i.e. the frequency information $F_{ml} - F_{m14}$) to the fraction and integer counters 5*a* – 5*c* with an interval of 1 $\phi$s per channel, thereby enabling a time-sharing control of the instrument.

IV. Generation of the Glide Code

Before explaining about the operation of the frequency information generator 4, generation of the glide codes $V_1 - V_6$ and the glide control signal GL will be described.

Figure 7:
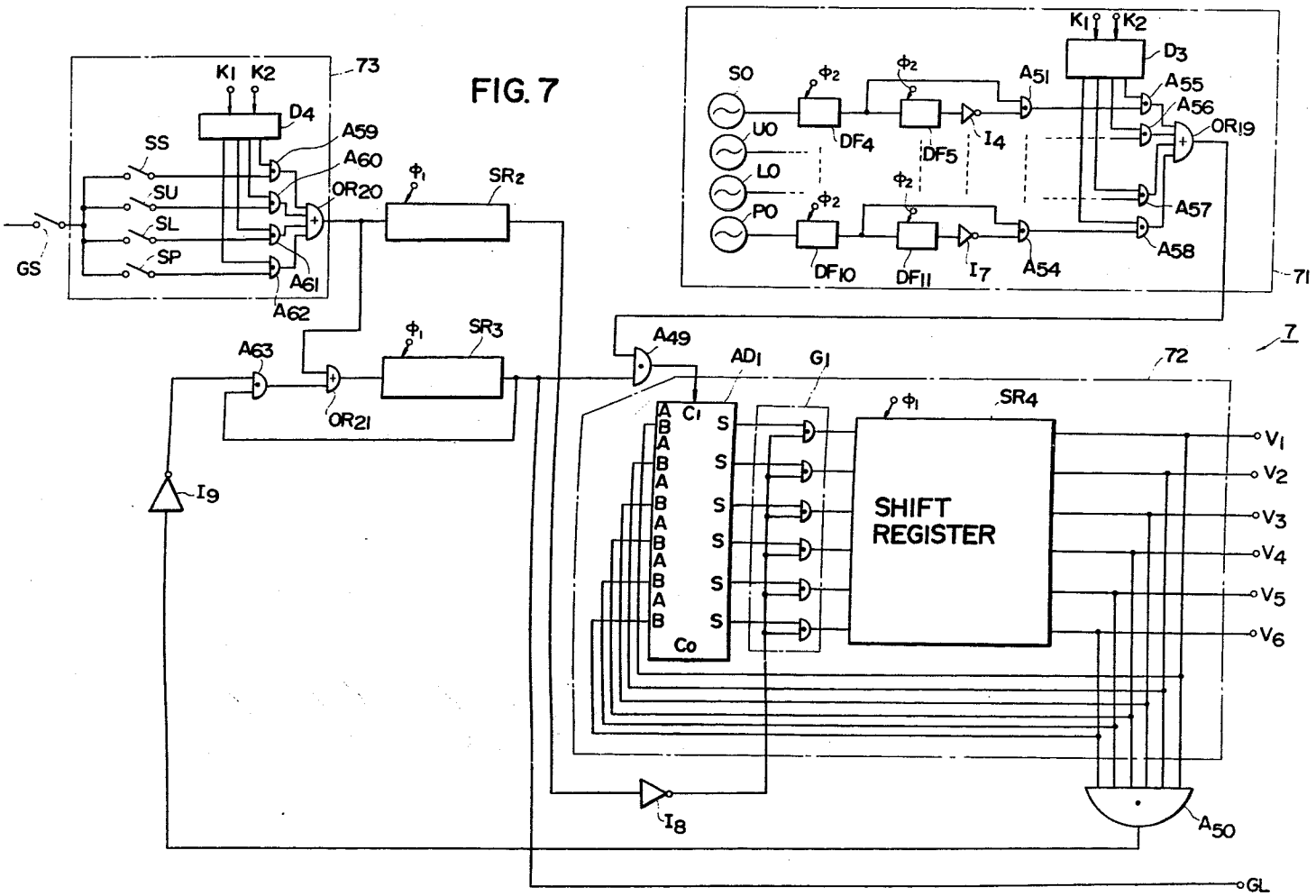
FIG. 7 is a circuit diagram showing a detailed logical circuit of a glide code generator 7 shown in FIG. 1.

FIG. 7 shows an embodiment of the glide code generator 7 capable of controlling glide individually for each keyboard. the glide code generator 7 comprises a clock selector circuit 71 and a glide counter 72. The clock selector circuit 71 corresponds to the above described clock generator *7a* and the glide counter 72 corresponds to the above described counter *7b*. The other component parts corresponding to the above described glide control section *7c*.

A common glide switch GS is provided for manual operation and, in case glide control for each individual keyboard is desired, a data selector circuit 73 having operators SS, SU, SL and SP for the respective keyboards is provided as in the present embodiment.

Upon throwing-in of the common glide switch GS, and AND circuit $A_{49}$ is enabled and the clock supplied by the clock selector circuit 71 is counted by the counter 72. When this count has amounted to a predetermined value, an AND circuit $A_{50}$ is enabled and the AND circuit $A_{49}$ is disenabled, causing the counting in the counter 72 to be stopped. Accordingly, the predetermined period of time during which the glide effect is produced (hereinafter referred to as "glide time") is determined by the frequency of the clock pulse counted by the counter 72. It will be noted that the rate or speed of the frequency change of a musical tone is also determined by the clock pulse.

Signals of selected frequencies and of a suitable waveshape (e.. a rectangular wave) are respectively produced from a solo keyboard signal oscillator SO, an upper keyboard signal oscillator UO, a lower keyboard signal oscillator LO and a pedal keyboard signal oscillator PO. If, or example, the glide time is 1 second and the counter 72 has 64 stages with the output of its final stage being input to the AND circuit $A_{50}$, the frequency of these signals is established at about 64 Hz.

An output signal "1" of the solo keyboard signal oscillator SO is applied to a delay flip-flop $DF_4$. The delay flip-flop $DF_4$ produces a signal "1" upon application thereto of an initial key clock pulse $\phi_2$. This signal "1" is applied to an AND circuit $A_{51}$ and also to a delay flip-flop $DF_5$. The output of the delay flip-flop $DF_5$ at this time is "0" and this signal "0" is inverted in an inverter $I_4$ and thereafter is applied to the AND circuit $A_{51}$. The AND circuit $A_{51}$ therefore produces a signal "1." Then, when the key clock pulse $\phi_2$ is applied to the delay flip-flop $DF_5$, the output of the delay flip-flop $DF_5$ becomes a signal "1" and, accordingly, the AND circuit $A_{51}$ produces a signal "0." Delay flip-flop $DF_6$ – $DF_{11}$ (not shown), inverters $IN_5$ – $IN_7$ (not shown) and AND circuits $A_{52}$ – $A_{54}$ (not shown) operate in a like manner.

Accordingly, pulse signals having a pulse width of one key time (12 $\mu$s) are produced from the AND circuits $A_{51}$ – $A_{54}$ from the time when the outputs of the oscillators SO – PO have changed from "0" to "1" and in response to the key clock pulse $\phi_2$. The periods of these pulse signals correspond to the frequencies of the respective oscillators. This is because the maximum number of musical tones to be reproduced simultaneously is 12 in the present embodiment.

The output corresponding to the keyboard of the depressed key is selected from the outputs of the AND circuits $A_{51}$ – $A_{54}$. The keyboard code $K_1$ and $K_2$ is applied to a decoder $D_3$ and a signal "1" is produced on the output line corresponding to the keyboard. A signal representing the solo keyboard SO is applied to the AND circuit $A_{55}$, one representing the upper keyboard UO to the AND circuit $A_{56}$, one representing the lower keyboard LO to the AND circuit $A_{57}$ and one representing the pedal keyboard PO to the AND circuit $A_{58}$, respectively. The AND circuits $A_{55}$ – $A_{58}$ also receive the outputs of the AND circuits $A_{51}$ – $A_{54}$ and, when one of these AND circuits $A_{55}$ – $A_{58}$ is enabled, a signal "1" (a clock pulse for producing a desired glide) is applied to the AND circuit $A_{49}$ through an OR circuit $OR_{19}$.

The terminals of the operators SS, SU, SL, SP are respectively connected to the inputs of corresponding AND circuits $A_{59}$ – $A_{62}$. The inputs of the AND circuits $A_{59}$ – $A_{62}$ are also connected to output lines each representing one of the keyboards of a decoder $D_4$. The keyboard code $K_1$, $K_2$ is applied to the decoder $D_4$ as well as to the decoder $D_3$. When the glide effect is desired, the operator for the selected keyboard is thrown-in and thereafter the common glide switch GS is switched on.

Assume that the operator SU for the upper keyboard is now ON. The AND circuit $A_{60}$ is enabled by switching-on of the common glide switch GS. Accordingly, the AND circuit $A_{60}$ produces a signal "1" when it receives the keyboard code $K_1$, $K_2$ representing the upper keyboard. This signal "1" is applied to a shift register $SR_2$ via an OR circuit $OR_{20}$ and to a shift register $SR_3$ via an OR circuit $OR_{21}$.

The shift register $SR_2$ and $SR_3$ are series type shift registers of 12 bits and are controlled by the main clock pulse $\phi_1$. The input signal applied thereto is output when one key time (12 $\mu$s) has elapsed.

The output signal "1" of the shift register $SR_2$ is inverted by an inverter $I_8$ thereby disenabling a gate circuit $G_1$ of the counter 72. The counter 72 comprises an adder $AD_1$, a 12 word (1 word = 6 bits) shift register $SR_4$ and the gate circuit $G_1$. The results of addition in the adder $AD_1$ are supplid to a corresponding channel of the shift register $SR_4$ every one key time whereby the clock pulses for 12 tones are counted in a time-sharing manner. Explanation will now be made about one channel only. The counted value of the counter 72 (i.e. glide code $V_1$ – $V_6$) becomes 0 when the output signal of the inverter $I_8$ becomes "0" thereby disenabling the gate circuit $G_1$ at a time point $t_O$ as shown in FIG. 8(a). When the common glide switch GS is switched off (A self resetting type switch is normally used as the switch GS. ) and the output signal of the OR circuit $OR_{20}$ thereby becomes "0," the output of the inverter $I_8$ becomes "1" one key time later, enabling the gate circuit $G_1$. This time is represented by a time point $t_1$.

During the interval between the time points $t_0$ and $t_1$, a signal "1" is also produced from the shift register $SR_3$, so that the AND circuit $A_{49}$ gates out the clock pulse to an input terminal $C_1$ of the adder $AD_1$. Since, however, the gate circuit $G_1$ is not enabled, the counting output during this interval is 0.

The output of shift register $SR_3$ is fed back to its input via an AND circuit $A_{63}$ and an OR circuit $OR_{21}$. The AND circuit $A_{63}$ receives at the other input terminal thereof a signal "1" via the AND circuit $A_{50}$ and an inverter $I_9$ when one of the bit outputs of the final stage of the shift register $SR_4$ is "0." Accordingly, the particular channel of the shift register $SR_3$ receives a circulating signal "1" every key time even after the switch GS is switched off.

Accordingly, the AND circuit $A_{49}$ continues to gate out the signal even after the switching-off of the switch GS and the counting operation of the counter 72 is started from the time point $t_1$. When 63 shots of clock pulse have been supplied from the clock selection circuit 71 after the time point $t_1$, the counting output of the particular channel becomes 63 and all of the bit outputs become "1." This enables an AND circuit $A_{50}$ and disenables the AND circuit $A_{63}$. The output signal of the shift register $SR_3$ becomes "0" one key time later. This time is denoted as a time point $t_2$. The AND circuit $A_{49}$ is not enabled after the time point $t_2$ so that the clock-pulse is not applied to the counter $AD_1$, so that the counting output 63 is maintained until a next throwing-in of the common glide switch GS.

Figure 8:
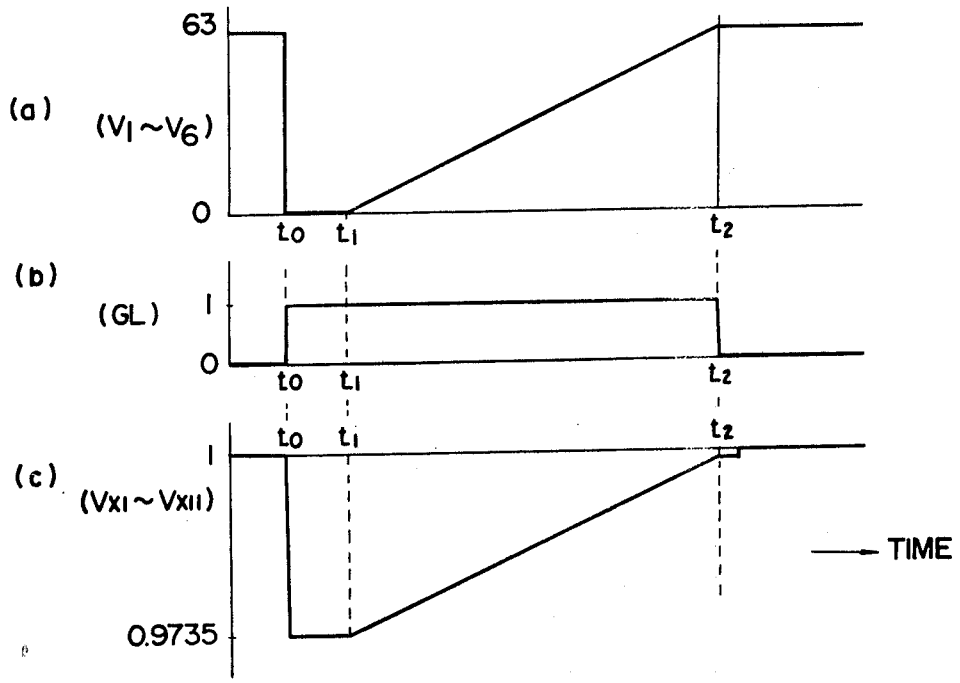
FIGS. 8(*a*) through 8(*c*) are graphic diagrams showing change of the glide code, glide designation signal and glide information in relation to time.

The counting output of the counter 72 is applied to the glide information generator 11 as the glide code $V_1 - V_6$. The output of the shift register $SR_3$ also is applied to the glide information generator 11 as the glide control signal GL as shown in FIG. 8(*b*).

The above explanation has been made about only one channel. The operation is the same in case of a multi-channel device as in the present embodiment, because the shift registers $SR_2$, $SR_3$ and $SR_4$ are operated in synchronization with each other by the main clock pulse $\phi_1$. In case of performing the glide control individually for each keyboard, only one kind of clock pulse may be produced from the clock selector circuit 71, and the data select circuit 73 is not required.

V. Generation of the glide information $V_{x1} - V_{x11}$

Figure 9:
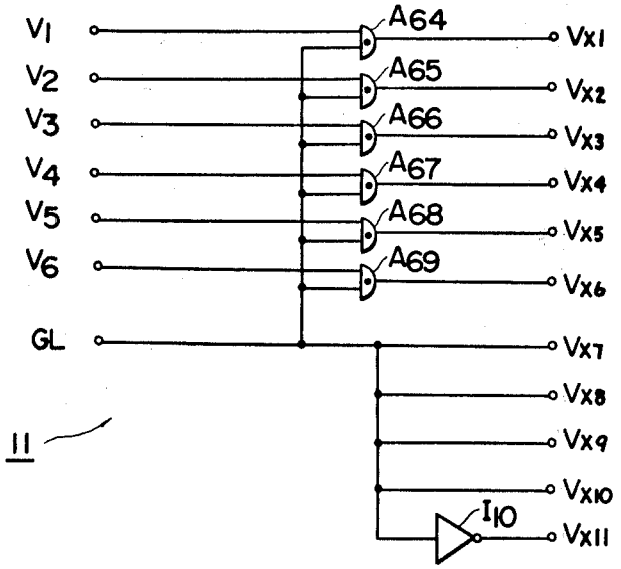
FIG. 9 is a circuit diagram showing a detailed logic circuit of a glide information generator shown in FIG. 5.

If the glide information $V_{x1} - V_{x11}$ is established in the form of a function which gradually increases from a frequency which is 112 cents lower than the basic frequency toward the basic frequency, the glide information generator 11 is constructed, by way of example, as shown in FIG. 9.

One cent is an interval of one hundredth of demiton in the equally tempered scale. Accordingly, a tone which is 100 cents below the note $c_1^{\#}$ is $c_1$. The glide information which is represented as a ratio to the basic frequency information $F_1 - F_{14}$ is divided into an integer section and a fraction section. $V_{x11}$ which corresponds to the most significant digit is allotted to the integer section and the rest of the information is allotted to the fraction section.

In the glide information generator 11 shown in FIG. 9, the glide code $V_1 - V_6$ is applied to AND circuits $A_{64}$–$A_{69}$. The AND circuits $A_{64} - A_{69}$ also receive the glide control signal GL. The outputs of the AND circuits $A_{64} - A_{69}$ become the less significant digits $V_{xl} - V_{x6}$ of the glide information and the glide control signal GL is directly output as the more significant digits $V_{x7} - V_{x10}$. An signal which is produced by inverting the glide control signal GL in an inverter $I_{10}$ is output as the most significant digit $V_{x11}$.

Accordingly, the glide information $V_{x1} - V_{x11}$ as shown in Table II is produced in response to the glide code $V_1 - V_6$.

Table II

| | Glide code | | | | | | Glide information | | | | | | | | | | |
|---|---|---|---|---|---|---|---|---|---|---|---|---|---|---|---|---|---|
| Address | $V_6$ | $V_5$ | $V_4$ | $V_3$ | $V_2$ | $V_1$ | $V_{x11}$ | $V_{x10} - V_{x7}$ | | | | | | $V_{x6} - V_{x1}$ | | | |
| 0 | 0 | 0 | 0 | 0 | 0 | 0 | 0 | 1 | 1 | 1 | 1 | 0 | 0 | 0 | 0 | 0 | 0 |
| 1 | 0 | 0 | 0 | 0 | 0 | 1 | 0 | 1 | 1 | 1 | 1 | 0 | 0 | 0 | 0 | 0 | 1 |
| 2 | 0 | 0 | 0 | 0 | 1 | 0 | 0 | 1 | 1 | 1 | 1 | 0 | 0 | 0 | 0 | 1 | 0 |
| . | | | . | | | | . | | | . | | | | . | | | |
| . | | | . | | | | . | | | . | | | | . | | | |
| . | | | . | | | | . | | | . | | | | . | | | |
| 15 | 0 | 0 | 1 | 1 | 1 | 1 | 0 | 1 | 1 | 1 | 1 | 0 | 0 | 1 | 1 | 1 | 1 |
| 16 | 0 | 1 | 0 | 0 | 0 | 0 | 0 | 1 | 1 | 1 | 1 | 0 | 1 | 0 | 0 | 0 | 0 |
| . | | | . | | | | . | | | . | | | | . | | | |
| . | | | . | | | | . | | | . | | | | . | | | |
| . | | | . | | | | . | | | . | | | | . | | | |
| 31 | 0 | 1 | 1 | 1 | 1 | 1 | 0 | 1 | 1 | 1 | 1 | 0 | 1 | 1 | 1 | 1 | 1 |
| 32 | 1 | 0 | 0 | 0 | 0 | 0 | 0 | 1 | 1 | 1 | 1 | 1 | 0 | 0 | 0 | 0 | 0 |
| 33 | 1 | 0 | 0 | 0 | 0 | 1 | 0 | 1 | 1 | 1 | 1 | 1 | 0 | 0 | 0 | 0 | 1 |
| . | | | . | | | | . | | | . | | | | . | | | |
| . | | | . | | | | . | | | . | | | | . | | | |
| . | | | . | | | | . | | | . | | | | . | | | |
| 46 | 1 | 0 | 1 | 1 | 1 | 0 | 0 | 1 | 1 | 1 | 1 | 1 | 0 | 1 | 1 | 1 | 0 |
| 47 | 1 | 0 | 1 | 1 | 1 | 1 | 0 | 1 | 1 | 1 | 1 | 1 | 0 | 1 | 1 | 1 | 1 |
| 48 | 1 | 1 | 0 | 0 | 0 | 0 | 0 | 1 | 1 | 1 | 1 | 1 | 1 | 0 | 0 | 0 | 0 |
| . | | | | | | | | | | | | | | | | | |
| . | | | | | | | | | | | | | | | | | |
| . | | | | | | | | | | | | | | | | | |
| 62 | 1 | 1 | 1 | 1 | 1 | 0 | 0 | 1 | 1 | 1 | 1 | 1 | 1 | 1 | 1 | 1 | 0 |
| 63 | 1 | 1 | 1 | 1 | 1 | 1 | 0 | 1 | 1 | 1 | 1 | 1 | 1 | 1 | 1 | 1 | 1 |

It will be noted from the table that when the glide control signal GL is "1," the most significant digit $V_{x11}$ (integer section) of the glide information is always "0" and all off the more significant digits $V_{x7} - V_{x10}$ are a signal "1." The AND circuits $A_{64} - A_{69}$ are enabled and gate out the value of the glide code $V_1 - V_6$ to the less significant digits $V_{x1} - V_{x6}$. When the glide control signal GL is "0," a signal of the most significant digit $V_{x11}$ only is "1" and signals of the rest of the digits $V_{x1} - V_{x10}$ are all "0." This signifies that the ratio of frequency change is 1, i.e. that the glide effect is not given when the glide control signal GL is "0."

Referring to Table II, the value of the glide information is 0.9375 in decimal notation when the glide code is at address 0. This value gives a frequency change of −112 cents to the basic frequency information $F_1 - F_{14}$. At address 16, the value of the glide information is 0.9531 in decimal notation, which gives a frequency change of −83 cents to the basic frequency information. Thus, the value of the glide information gradually approaches the value of the basic frequency information as the value of the glide code $V_1 - V_6$ increases. The value of the glide information at the 63rd address is 0.9990, which gives a frequency change in the order of −0.5 cent only. After the glide code $V_1 - V_6$ has become 63, the glide control signal GL becomes "0" as has previously been described, and the glide information $V_{x1} - V_{x11}$ becomes 1, producing no frequency change at all. In the above described manner, the glide information $V_{x1} - V_{x11}$ in the form of a function as shown in FIG. 8(c) is produced in accordance with the glide code $V_1 - V_6$ and the glide control signal GL. Since the counting output of the couner 72 is 370" and the signal GL is "1" during the interval between the time points $t_0$ to $t_1$, the value of the glide information is 0.9375 designating −112 cents. The value of the glide information gradually increases (it actually increases in steps) until it becomes 1 at the time point $t_2$ when the production of glide is completed. The value of the glide information $V_{x1} - V_{x11}$ changes in 64 steps in accordance with its address before one round of glide production process is completed. Accordingly, the value of the glide information $V_{x1} - V_{x11}$ changes approximately every 15.6 ms assuming that the glide time is about 1 second.

The range of the frequency change is not limited to the order of 100 cents but it may be several hundred cents or several scores of cents. The glide information generator 11 may be constructed of a suitable logical circuit or a read-only memory.

VI. Generation of Frequency Information $F_{ml} - F_{ml4}$

Generation of the frequency information $F_{ml - Fm14}$ will now be described with reference to FIGS. 5 and 6.

Figure 6:
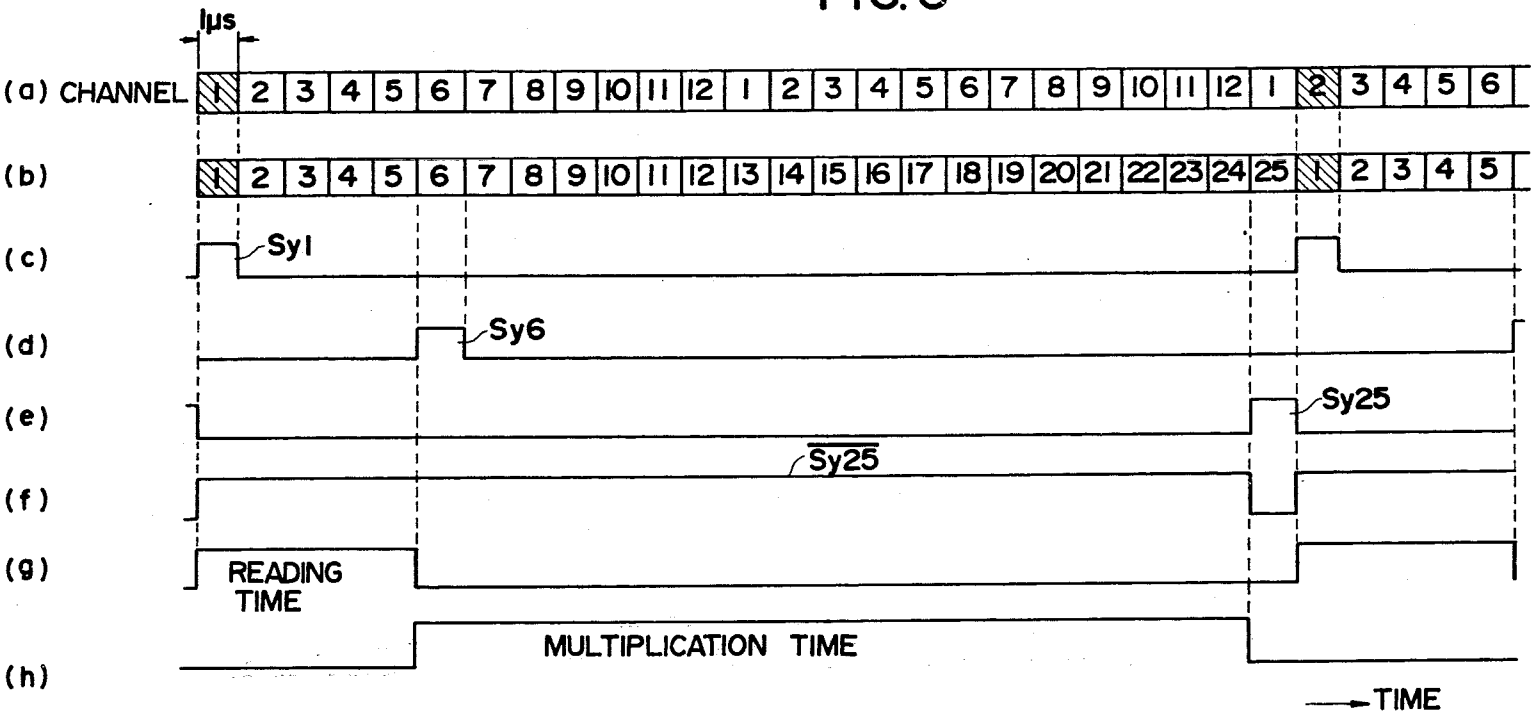
FIGS. 6(*a*) through 6(*h*) are timing charts illustrative of signals at respective points in the frequency information generator 4 shown in FIG. 5.

Assume that the synchronizing pulse Sy 1 is applied to the sample hold circuits 9*a* and 9*b* when the key address code $N_1$-$K_2$ of the 1st channel is produced from the key assigner 3 as shown in FIG. 6(*a*). The glide code $V_1 - V_6$ and the glide control signal GL at this time are also information of a keyboard corresponding to the key address code $N_1$- $K_2$ of the 1st channel. In response to such information the glide information $V_{x1} - V_{x11}$ is produced in the glide information generator 11 and the basic frequency information $F_1 - F_{14}$ is read from the frequency information memory 10. Since the first and second gate circuits 12*a*, 12*b* are enabled by the synchronizing pulse Sy 6, the production of the glide information $V_{x1} - V_{x11}$ and the reading of the basic frequency /information $F_1 - F_{14}$ are performed within 5 μs as shown in FIG. 6(g). This arrangement ensures sufficient response time for the frequency information memory 10 and the glide information generator 11. As a result, a read-only memory of a low operation speed may effectively be used in the frequency information memory 10 and, accordingly, the frequency information generator 11 can be made compact and manufactured at a relatively low cost.

Upon application of the synchronizing pulse Sy 6, the glide information $V_{x1}$- $V_{x11}$ is stored in the multiplier shift registers of the multiplier 13 and the basic frequency information $F_{1 - F14}$ in the multiplicand shift register of the multiplier 13. The multiplication is conducted during 19 μs until the synchronizing pulse Sy 25 is produced as shown in FIG. 6 (*h*). This 19 μs period includes time required for repeating addition and for final carrying to ensure production of accurate results of multiplication $a_1 - a_{14}$.

Upon application of the synchronizing pulse Sy 25, the output $a_1 - a_{14}$ are applied to the output shift register group 15 via the third gate circuit 14. These outputs $a_1 - a_{14}$ represent the result of the multiplication of the basic frequency information $F_1 - F_{14}$ of the first channel and the glide information $V_{x1} - V_{x11}$ of the first channel and, therefore constitute frequency-modulated frequency information. Accordingly, the frequency information $F_{ml - Fm14}$ of the 1 channel is stored in the output shift register 15. The frequency-information $F_{m1} - F_{m14}$ is output from the output shift register 15 12 μs later. The output of the output shift register 15 is supplied to the counters 5*a* - 5*c* and simultaneously fed back to the output shift register 15. Subsequent frequency information $F_{m1} - F_{m14}$ is applied to the counters 5*a* - 5*c* in a like manner at every key time.

When a next synchronizing pulse Sy 1 is produced as shown in FIG. 6(*c*), information of the 2nd channel is applied to the sample hold circuits 9*a*, 9*b* as shown in FIG. 6(*a*). Thus, the frequency-modulated frequency information $F_{ml} - Fm_{14}$ of the 2nd channel is stored in the corresponding channel of the output shift register 15. Subsequently, at every application of the synchronizing pulse Sy 1 (with a perod of 25μs), the glide information $V_{x1} - V_{x11}$and the basic frequency information $F_1 - F_{14}$ of subsequent channels are sequentially multiplied with each other and the result of the multiplications, i.e. the frequency information $F_{ml} - F_{m14}$, is successively stored in the corresponding channels of the output shift register 15 upon application of the synchronizing pulse Sy 25. Since the maximum number of musical tones to be reproduced simultaneously is 12, a period with which the frequency information $F_{ml} - F_{m14}$ of a particular channel is stored in the output shift register 15 is 25 μs × 12 = 300 μs.

Assuming that the glide time is about 1 second, the value of the glide information $V_{x1} - V_{x11}$ changes with a period of about 15.6 ms. Accordingly, a period with which the frequency information $F_{ml} - F_{m14}$ of the particular channel is rewritten in the output shift register 15 is much longer than 300 μs, i.e. about 15.6 ms in the above described embodiment.

Table III shows an example of the frequency information $F_{ml} - F_{m14}$ output from the output shift register 15 with respect to the note $E_5$. In the table, the data is expressed in a decimal notation.

Table III

| Glide control signal GL | $V_1 - V_6$ Address | Glide information $V_{xl} - V_{x11}$ | $E_5$ = 1.054808 Frequency information $F_{ml} - F_{m14}$ |
|---|---|---|---|
| 0 | | 1.0000 | 1.054808 |
| | 0 | 0.9375 | 0.988882 |
| | . | . | . |
| | . | . | . |
| | . | . | . |
| | 16 | 0.9351 | 1.005337 |
| | . | . | . |
| | . | . | . |
| | . | . | . |
| | 32 | 0.9688 | 1.021897 |
| | . | . | . |
| | . | . | . |
| | . | . | . |
| 1 | 48 | 0.9844 | 1.038352 |
| | . | . | . |
| | . | . | . |
| | . | . | . |
| | 63 | 0.9990 | 1.053753 |
| 0 | | 1.0000 | 1.054808 |

As will be apparent from this table, the basic frequency information is directly output as the frequency information $F_{ml} - F_{m14}$ when the glide control signal GL is "O," and the frequency information $F_{ml} - F_{m14}$ which has been frequency-modulated by the glide information $V_{x1} - V_{x11}$ is output when the glide control signal GL is "1." It will be noted that the values of the glide information $V_{x1} - V_{x11}$ in a decimal notation corresponds to the values in a binary notation shown in Table II.

In the above described manner, the frequency-modulated frequency information $F_{ml} - F_{m14}$ is output from the output shift register 15 in a time sharing manner.

VII. Generation of a Musical Tone Waveshape

The least significant digit up to the sixth digit of the frequency information $F_{ml} - F_{m14}$ are applied from the output shift register 15 to the fraction counter 5*a*, those from the seventh digit up to the thirteenth digit to the fraction counter 5*b*, and the most significant digit to the integer counter 5*c* respectively. The counters 5*a*- 5*c* comprise adders $AD_2$ - $AD_4$ and shift registers $SF_1$ -

Figure 10:
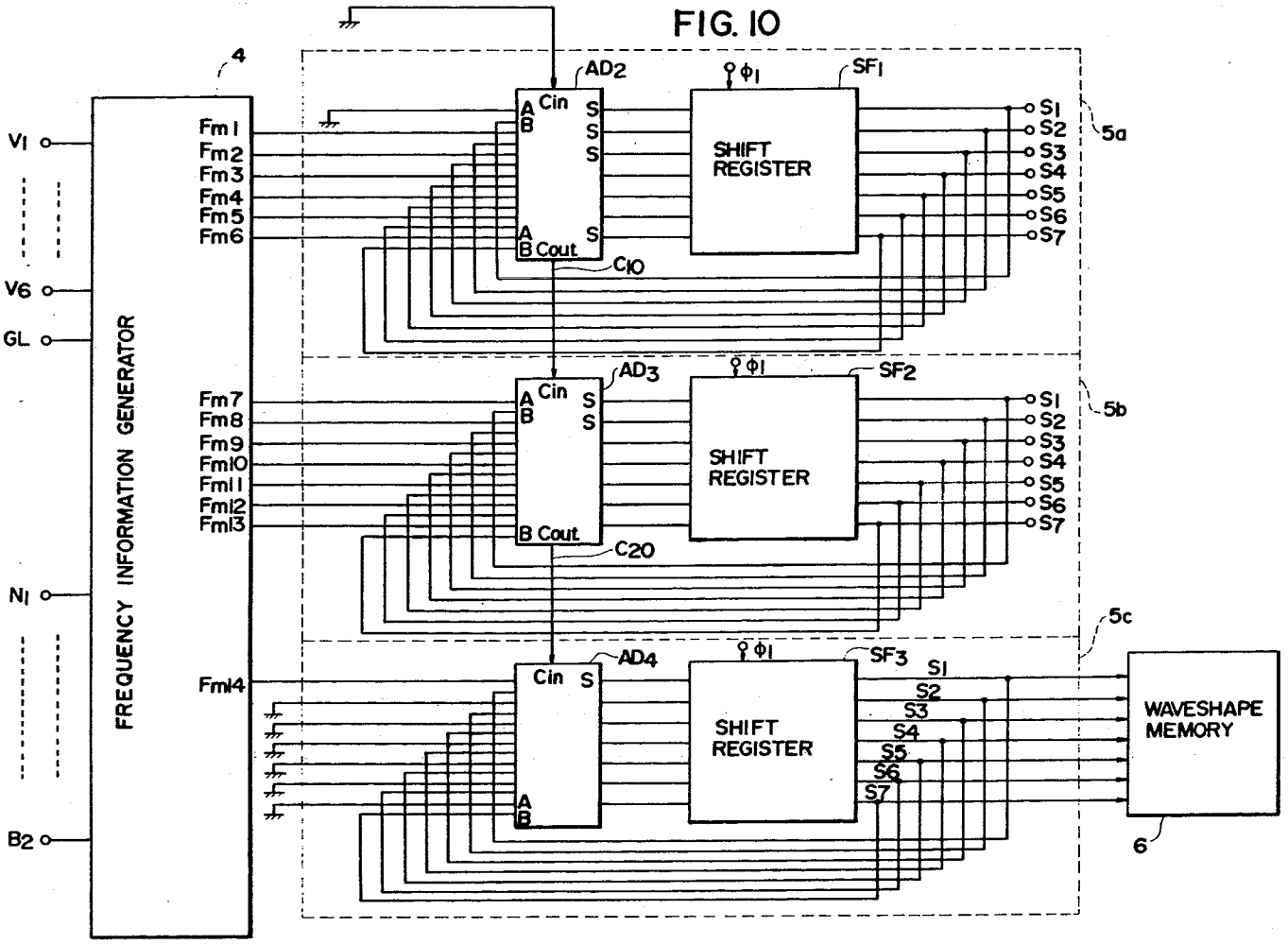
FIG. 10 is a block diagram showing in detail fraction counters 5*a*, 5*b* and an integer counter 5*c*.

$SF_3$ as shown in FIG. 10. Each of the adders $AD_2$ – $AD_4$ adds the output from the corresponding one of the shift registers $SF_1$ – $SF_3$. The shift registers $SF_1$ – $SF_3$ are adapted to store the 12 kinds of outputs in time sequence from the adders $AD_2$ – $AD_4$ temporarily and feed them back to the input side of the adders $AD_2$ – $Ad_4$. The shift register $SF_1$ – $SF_3$ respectively have the same number of stages as the maximum number of musical tones to be reproduced simultaneously, e.g. 12 as in the present embodiment. This is an arrangement made for operating the frequency counters in a time-sharing sequence manner, since the frequency information memory 4 receives in time sharing the key address codes stored in the 12 channels (shift register stages) of the key address code memory KAM and produces the frequency information for the respective channels.

Explanation will now be made about this arrangement with respect to the first channel. If the contents of the first channel of the shift register $SF_1$ of the fraction counter 5*a* are "0," frequency information signals $F_{ml}$ through $F_{m6}$ i.e. the first 6 bits of the fraction section are initially stored in the first channel of the shift register $SF_1$. After a lapse of one key time, new frequency information signals $F_{m1}$ through $F_{m6}$ are added to the contents already stored in the first channel. This addition is repeated at every key time and the signals $F_{ml}$ through $F_{m6}$ are cumulatively added to the stored contents. When a carry takes place in the addition, a carry signal $C_{10}$ is applied from the counter 5*a* to the next counter 5*b*. The fraction counter 5*b* consisting of the adder $AD_3$ and the shift register $SF_2$ likewise makes cumulative addition of frequency information signals $F_{m7}$ through $F_{ml3}$ i.e. the next 7 bits of the fraction section, and the carry signal $C_{10}$ applying a carry signal $C_{20}$ to the adder $AD_4$ when a carry takes place as a result of the addition. The integer counter 5*c* consisting of the adder $AD_4$ and the shift register $SF_3$ receives the single digit $F_{m14}$ and the carry signal $C_{20}$ from the adder $AD_3$ and makes cumulative addition in the same manner as has been described with respect to the fraction counters 5*a* and 5*b*. The integer outputs of 7 bits stored in the first channel of the shift register $SF_3$ are successively applied to the musical tone waveshape memory 6 for designating the reading addresses to read.

If sampled amplitudes of one period of musical tone to be reproduced are stored in the memory 6 with a sampling number $n=64$, a counter having 64 stages is employed as the integer counter 5c so that reading of one period of the musical tone waveshape is completed when the cumulative value of the frequency information $F_{ml}$ – $F_{m14}$ has become 64.

When the glide control signal GL is "0," i.e. the glide switch is not switched on, the basic frequency information $F_1$ – $F_{14}$ is directly applied to the counters 5*a* – 5*c* and a period of reading the waveshape memory is constant. Accordingly, a musical tone of a constant frequency is reproduced. On the other hand, when the glide control signal GL becomes "1" as shown in FIG. 8(*b*), the value of the frequency information $F_{m1}$ – $F_{m14}$ changes as shown in Table III.

Referring to FIG. 8(*c*), a musical tone having a frequency which is 112 cents lower than the basic frequency designated by depression of a key is produced during the interval between the time points $t_0$ and $t_1$ during which the glide information $V_{x1}$ – $x_{X11}$ is 0.9375. After the time point $t_1$ the frequency gradually increases to produce a musical tone with the glide effect until the time point $t_2$ when the frequency amounts to the basic frequency and production of the glide effect ceases. Thus, 12 musical tones provided with the glide effect are produced in a time-sharing manner and the glide effect can be controlled individually for each keyboard.

Figure 11:
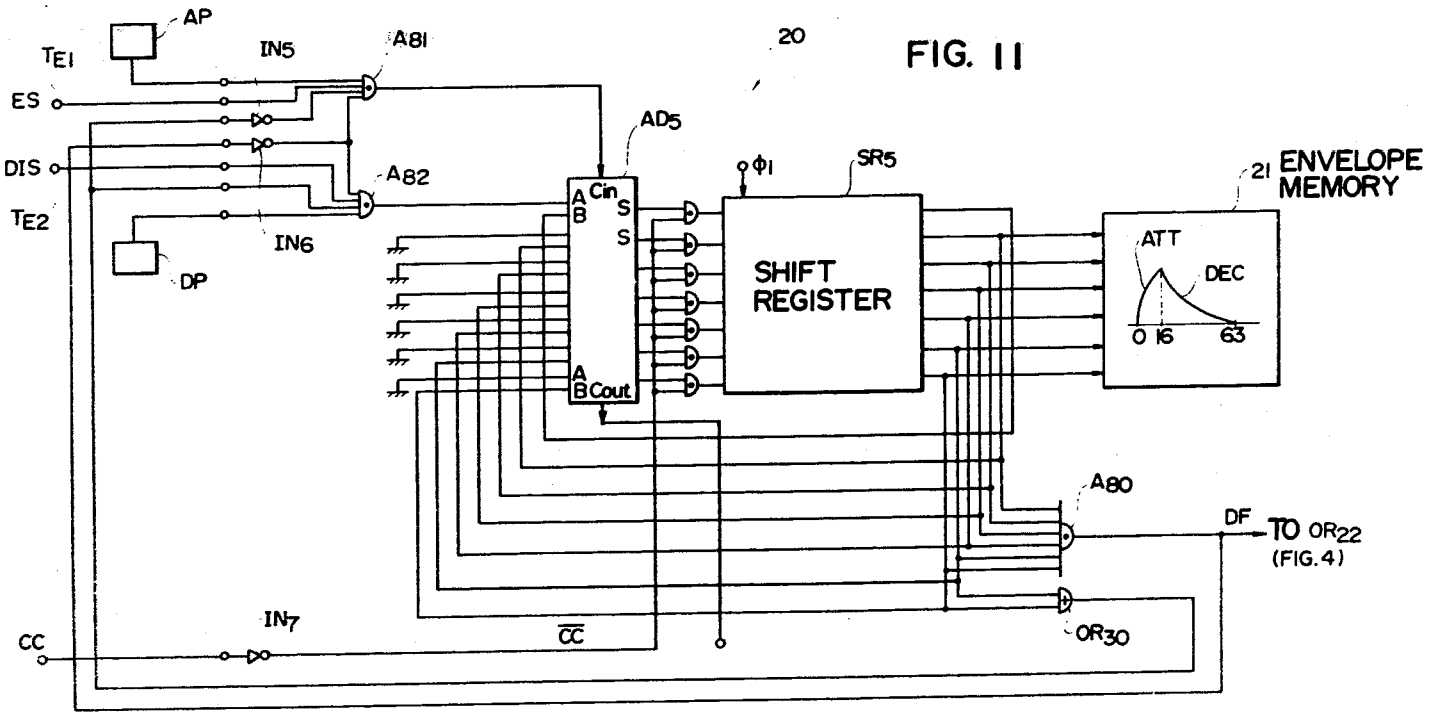
FIG. 11 is a circuit diagram showing a detailed logical circuit of an envelope counter shown in FIG. 1.

The musical tone waveshape is read from the musical tone waveshape memory 6, whereas the entire level of the musical tone is controlled by the output of an envelope memory 21. Reading of the envelope memory 21 is controlled by an envelope counter 20. Reading of an envelope waveshape will now be described with respect to the envelope counter 20 shown in FIG. 11.

The envelope counter 20 comprises an adder $AD_5$ and a 12 word 7 bit shift register $SR_5$, the result of addition in the adder $AD_5$ being supplied every 1 key time to corresponding channels of the shift register $SR_5$. More specifically, the adder $AD_5$ adds the output of the shift register $SR_5$ and the clock pulse and provides a result S to the input terminal of the shift register $SR_5$ thereby causing the envelope counter 20 to successively effect a cumulative counting with respect to each of the the channels.

An output representing a counted value is applied from this envelope counter to an envelope memory 21 and a waveshape amplitude stored at an address corresponding to the counted value is successively read from this memory 21. The envelope memory 21 stores an attack waveform ATT at addresses starting from 0 to a predetermined address, e.g. 16,and a decay waveform DEC at addresses from the next address to the last one, e.g. 63.

The counting operation of the envelope counter will now be described with respect to the first channel.

When the attack start signal ES is applied to a terminal $TE_1$, an AND circuit $A_{81}$ which has already received signals "1" obtained by inverting outputs "0" of an AND circuit $A_{80}$ and an OR circuit $OR_{30}$ respectively by inverter $IN_5$ and $IN_6$ gates out an attack clock pulse AP to the adder $AD_5$. The adder $AD_5$ and the shift register $SR_5$ successively count the attack clock pulses thereby reading out the attack waveshape of the envelope memory 21. When the counted value has reached 16, an output "1" is produced from the OR circuit $OR_{30}$ and, accordingly, the attack clock pulse AP ceases to pass through the AND circuit $A_{81}$. The attack close pulse AP remains prevented from passing the AND circuit $A_{81}$ with respect to subsequent counts. Consequently, counting is once stopped and the amplitude stored at address 16 of the envelope memory 21 continues to be read out. Thus, a sustain state is maintained.

In this state, an AND circuit $A_{82}$ receives a signal "1" from the OR circuit $OR_{30}$ and also a signal "1" which is obtained by inverting the output "0" of the AND circuit $A_{80}$ by the inverter $I_6$. When the decay start signal DIS is applied to a terminal $TE_2$, decay clock pulse DP passes through the AND circuit $A_{82}$ and is applied to the adder $AD_5$. This causes the envelope counter to resume the counting operation for counted values after 16 and the decay waveshape is read from the envelope memory 21. When the counted value has reached 63, all of the inputs to the AND circuit $A_{80}$ become "1" so that the AND circuit $A_{80}$ produces an output "1."Accordingly, the AND circuit $A_{82}$ ceases to gate out the decay clock pulse DP and the counting operation is stopped. Thus, the reading of the envelope waveshape has been completed.

The foregoing description has been made about the embodiment according to which the maximum frequency change during the glide time (hereinafter referred to as "glide depth") is constant (−112 cents). The invention is not limited to this but the glide depth may be varied as desired. More specifically, a predetermined counted value may be established in the glide counter 72 shown in FIG. 7 simultaneously with start of production of the glide effect, the counting of the clock pulse being started from this predetermined counted value. This predetermined counted value is of course determined in accordance with the glide depth. If, for example, the predetermined counted value is 32, the counter 72 starts counting from 32 and finishes it at 63. The glide depth in this case is about half that in a case where counting is started from 0 (in the present embodiment, about −55). A device for establishing the predetermined counted value is not particularly shown but it may be constructed of an operator for setting various counted values, a matrix circuit for converting the output from this operator into binary data of the selected counted value and a logical circuit for supplying the output of this matrix circuit to the counter 72. A data select circuit consisting of a decoder for decoding the keyboard code $K_1$, $K_2$ and AND gates may further be provided in the device for establishing the predetermined counted value to enable the device to control the glide depth individually for each keyboard.

VIII. Generation of the Accent Effect

Figure 12:
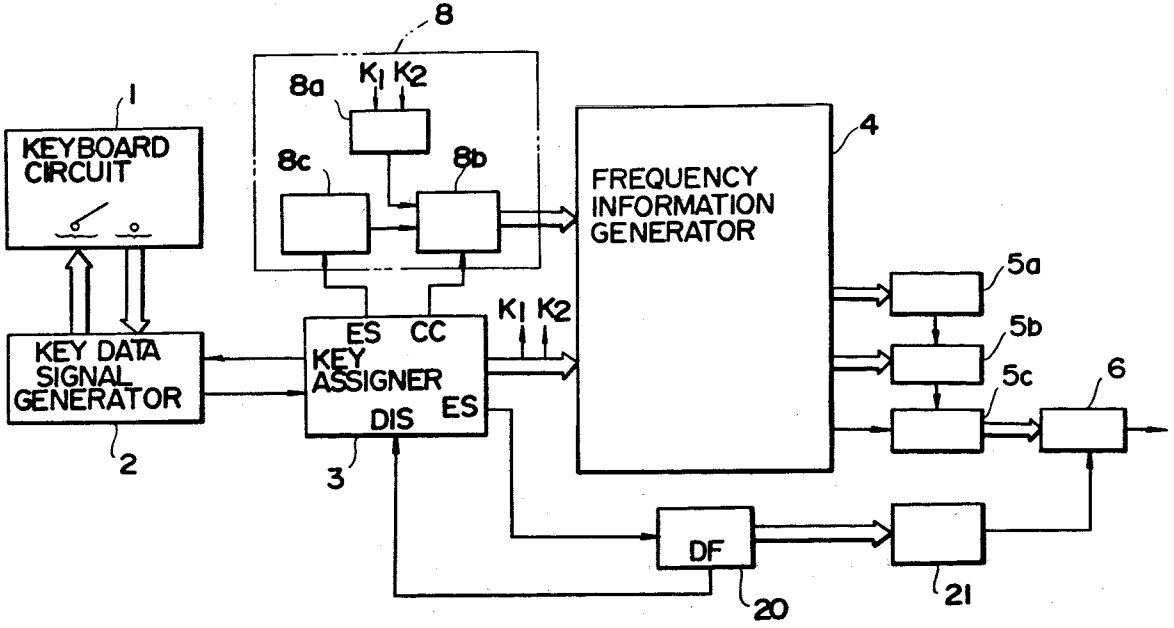
FIG. 12 is a block diagram showing another embodiment of the electronic musical instrument according to the invention.

FIG. 12 shows another embodiment of the electronic musical instrument according to the invention. In the previously described embodiment, a desired glide effect can be obtained by closing of the glide switch. In the present embodiment, an accent is given to the rise portion of a musical tone by quickly and smoothly changing the frequency of the rise portion of the musical tone.

In FIG. 12, a main difference from the embodiment shown in FIG. 1 is provision of a pitch code generator 8 instead of the glide code generator. Other component parts of the present embodiment are constructed in the same manner as in the embodiment shown in FIG. 1 so that detailed description thereof will be omitted.

The pitch code generator 8 comprises a pitch counter **8*b* which counts a clock pulse produced from a clock pulse generation circuit 8*a* during a predetermined period of time from the start of depression of a key and a counter control section 8*c* which controls start and stop of counting of the pitch counter 8*b* in response to a signal ES supplied from the key signer 3 and representing depression of a key. The counter 8*b* is constructed in such a manner that a desired initial value can be established and the counting is completed when the counted value has amounted to a predetermined value. The counting output is applied to a circuit 11 of the frequency information generator 4 where pitch information is produced. This pitch information is expressed as a pitch change in the form of a function responsive to the output of the counter 8*b***.

Figure 13:
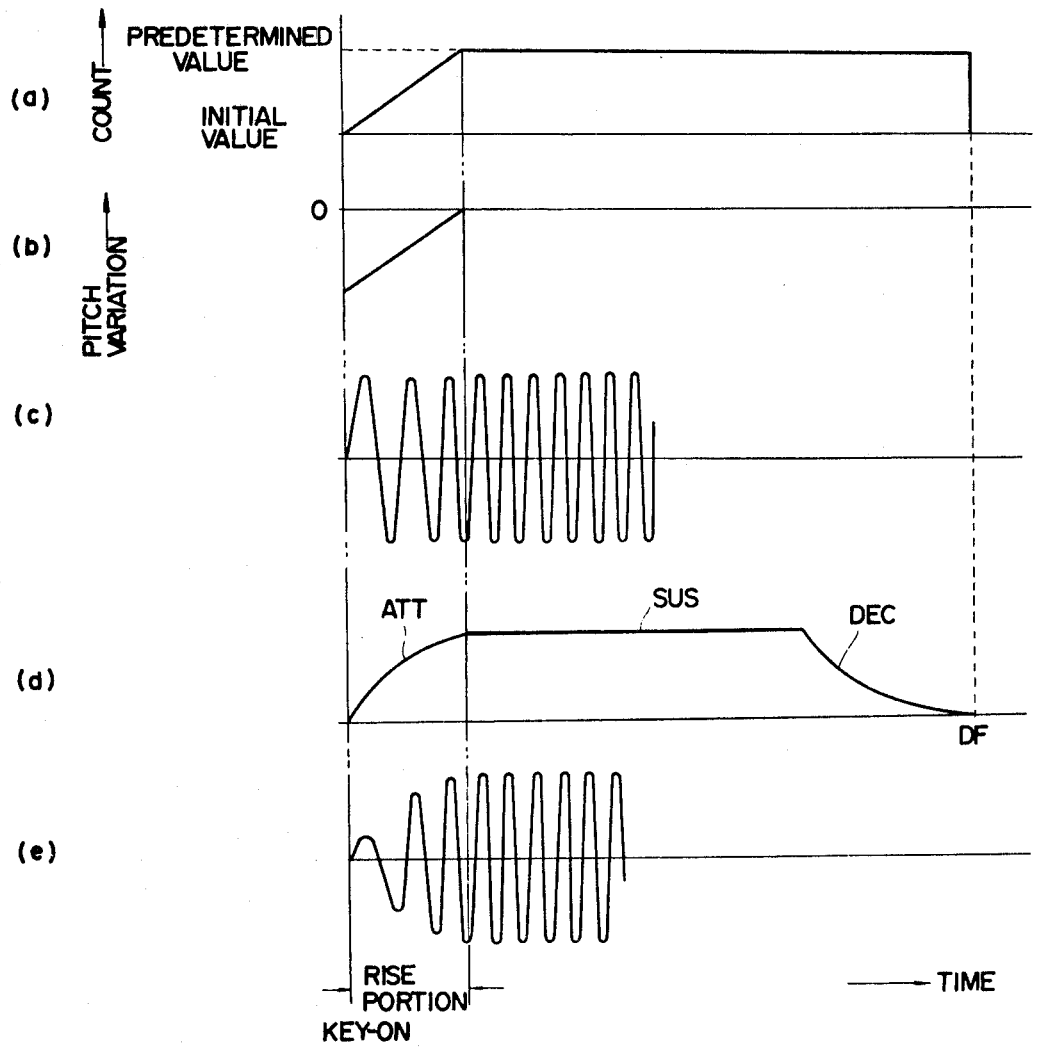
FIGS. 13(*a*) through 13(*e*) are graphic diagram schematically showing outputs of the respective parts in FIG. 12.

FIG. 13(*a*) schematically shows a state of change of the counted value of the counter **8*b* from an initial valus I to a predetermined value II. FIG. 13**(*b*) schematically shows the function of the pitch change. Accordingly, a frequency-modulated musical tone waveshape as shown in FIG. 13(*c*) is produced from the waveshape memory 6 in accordance with the pitch information. On the other hand, the entire level of the reproduced musical tone is controlled by the output of the envelope memory 21. If an envelope signal as shown in FIG. 13(*d*) is read out, a muscial tone waveshape as shown in FIG. 13(*e*) is produced from the electronic musical instrument according to the invention. Alternatively stated, the frequency of a musical tone to be reproduced gradually changes in the rise portion of the tone until the tone has risen to a substantially constant amplitude level and the tone thereafter is reproduced with a predetermined constant frequency.

Figure 14:
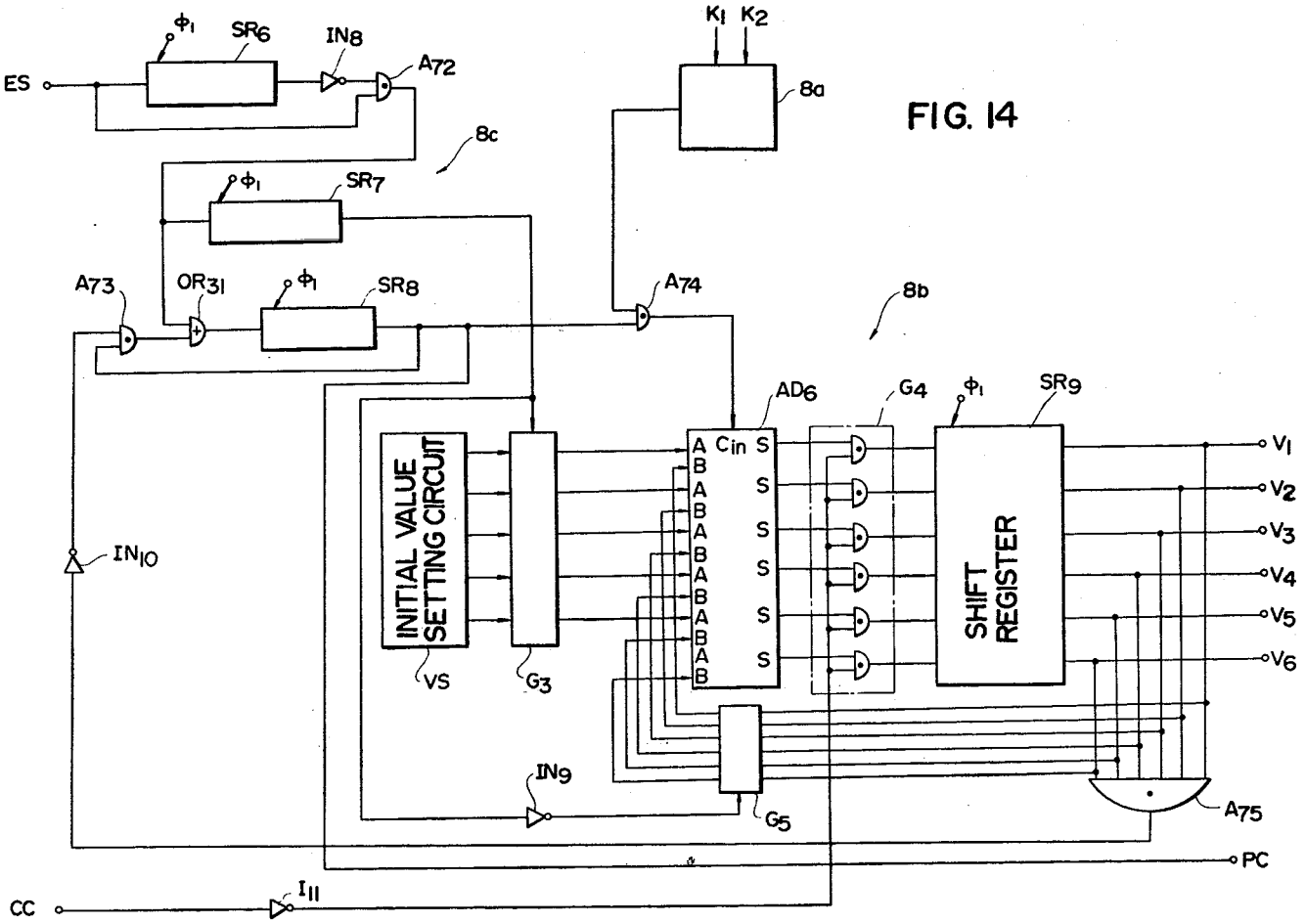
FIG. 14 is a diagram showing a circuit diagram of one example of a pitch counter 10 and a pitch counter control section 11.

FIG. 14 is a block diagram showing an example of the pitch counter **8*b* and the counter control section 8*c*. The counter control section 8*c* comprises 12 bit shift registers $SR_6$ – $SR_8$ and the pitch counter 8*b* comprises an adder $AD_6$ and a 12 word (one word consisting of 6 bits) shift register $SR_9$. The 12** bit shift registers are employed as the shift registers $SR_6$ – $SR_8$ because a maximum number of stones to be reproduced simultaneously is 12 in the present embodiment. The following explanation is made about one channel only for vrevity of description.

Figure 15:
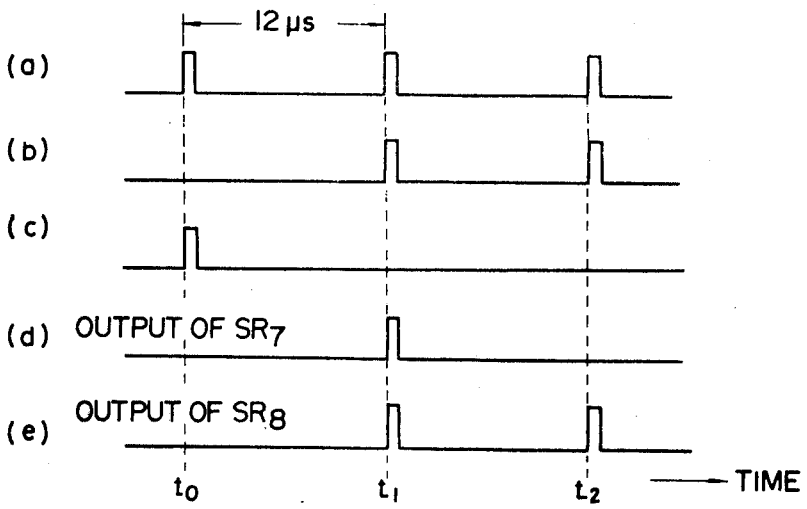
FIGS. 15(*a*) through 15(*e*) are timing charts showing signals at respective points in FIG. 14.

Upon depression of a key, an attack start signal ES is applied from the key assigner 3 to a particular channel of the shift register $SR_{26}$ from a time point $t_0$ as shown in FIG. 15(*a*).

The output of the particular channel of the shift register $SR_6$ becomes "1" from a time point $t_1$ which is one key time delayed as shown in FIG. 15(*b*).

Since this output "1" is inverted in an inverter $IN_8$ and thereafter is applied to an AND circuit $A_{72}$, the output of the AND circuit $A_{72}$ is "1" as shown in FIG. 15(*c*) only when an initial shot of the attack start signal ES is applied at the time point $t_0$ (substantially coinciding with the time when the depression of the key is started). This output signal "1" of the AND circuit $A_{72}$ is applied to the shift register $SR_7$ and also to the shift register $SR_8$ via the OR circuit $OR_{31}$ and output from these shift registers $SR_7$ and $SR_8$ one key time later, i.e. at the time point $t_1$.

The output of the shift register $SR_7$ which becomes "1" only at the time point $t_1$ as shown in FIG. 15(*d*) is applied to a gate circuit $G_3$ and also to a gate circuit $G_5$ via an inverter $IN_9$. The output of the shift register $SR_8$ is fed back to its input side via an AND circuit $A_{73}$ and the OR circuit $OR_{31}$ and, as shown in FIG. 15(*e*), a signal "1" is produced from the particular channel of the shift register $SR_8$ every key time after the time point $t_1$. This output signal "1" is applied to an AND circuit $A_{74}$ as a count control signal and also to a circuit **9*b* of the frequency information generator 4** as a pitch frequency output control signal PC instead of the glide control signal GL.

The output signal "1" of the shift register $SR_7$ applied to the gate circuit $G_3$ at the time point $t_1$ enables the gate circuit $G_3$ and thereby causes an initial value from an initial value setting circuit VS to be applied to an input terminal A of tlie adder $AD_6$. At a time point $t_2$ which is one key time later, the initial value is output from the shift register $SR_9$ and applied to a gate circuit $G_5$. At this time, the output signal of the shift register $SR_7$ is "0". This signal is inverted in the inverter $IN_9$ and thereafter is applied to the gate circuit $G_5$ to enable it. The output of the shift register $SR_9$ is fed back to an input terminal B of the adder $AD_6$. The adder $AD_6$ adds this signal to the clock pulse produced by the clock pulse generation circuit **8*a* and supplied via an AND circuit $A_{74}$. If the clock pulse has already been applied at the time point $t_1$, the counting output applied to the adder $AD_6$ via the gate circuit $G_5$ at the time point $t_2$ is not the initial value but a value obtained by adding 1 to the initial value. In the above described manner, the pitch counter 8*b*** starts its counting operation substantially from the time point $t_1$ in response to the attack start signal ES.

When all of the bit outputs of the final stage of the shift register $SR_9$ have become "1" (i.e. at the count 63), the AND circuit $A_{75}$ is enabled and a signal "0" is applied to the AND circuit $A_{73}$ via an inverter $IN_{10}$ to disenable it. This stops circulation of the signal "1" in the particular channel of the shift register $SR_8$ so that the control signal PC becomes "0". Accordingly, application of the clock pulse to the adder $AD_6$ is prevented and the counting operation of the pitch counter 8*b* is stopped.

Figure 16:
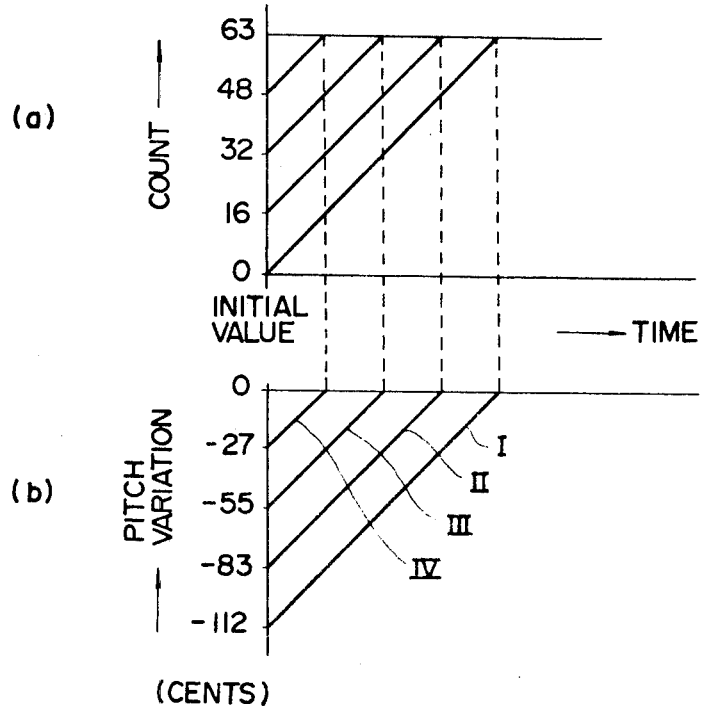
FIGS. 16(*a*) and 16(*b*) are graphic diagram showing relation between the counting output of the pitch counter corresponding to various initial values and the pitch information.

The initial value setting circuit VS is capable of establishing a desired initial count value from which the counting is to be started. If, for example, the initial value is set at 0, the counting is stopped when 63 shots of the clock pulse have been supplied. If the initial value is set at 48, the counting is stopped when 15 shots of the clock pulse have been supplied. Since the pitch information is expressed as the pitch change in the form of a founction corresponding to the output of the counter 8*b*, setting of a different initial value results in a different initial condition of the pitch change. The depth of the pitch change therefore can be determined as desired by setting the initial value at a suitable value. FIG. 16(*a*) is a graphic diagram showing counting outputs of the pitch counter 8*b* in a case where the initial value is set at 0, 16, 32 and 48.

Time required for counting is determined by a period of generation of the counting clock pulse. The clock pulse generation circuit 8*a* may be constructed in such a manner that it can produce a different clock pulse for each keyboard. In this case, a clock pulse corresponding to a particular keyboard is produced in response to the keyboard code $K_1$, $K_2$. Time required for counting is made different depending upon the keyboard of the depressed key so that the pitch change in the rise portion of the tone is made different depending upon the keyboard.

Assume that rise time of a tone during which the pitch change is given is 10 ms and that the initial value is 48. Since in this case 15 shots of counting clock pulse are applied during this 10 ms period of time, the period of the counting clock pulse is approximately 666 μs.

If the rise time of the tone is 10 ms, this signifies that the period of the attack envelope ATT is 10 ms. Accordingly, the period of the attack pulse AP and the counting clock pulse are made substantially the same as each other. If the initial value is set at 0 under the above described conditions, time required for counting in the pitch counter 8*b* is longer than in the case where the initial value is 48, resulting in production of a slight pitch change at the beginning of the sustain state.

The output "1" of an AND circuit $A_{80}$ of the envelope counter 20 is applied to the key assigner 3 as a count finish signal Df and thereafter is applied to the pitch counter 8*b* as a reset signal CC. This signal is inverted in an inverter $I_{11}$, disenabling the gate circuit $C_4$. Application of the signal from the adder $AD_6$ to the shift register $SR_9$ is thereby prevented and contents of the particular channel of the shift register $SR_4$ are reset.

What is claimed is:

1. An electronic musical instrument comprising:

means for generating a key address code corresponding to a depressed key;

a frequency information memory for storing basic frequency information corresponding to notes of respective keys and producing, upon receipt of said key address code, frequency information corresponding to said key address code;

a glide code generator comprising a clock pulse generator, a counter for counting the clock pulses generated and producing a glide code output which progressively changes in value with the pulse count, and a glide controller for controlling the counting operation of said counter to perform counting during only a predetermined period of time;

a glide information generator coupled to said glide code generator and responsive to the glide code output thereof for producing a glide information output which initially represents a value other than 1 and thereafter changes in equal increments in time step with said glide code output until it represents a value equal to 1;

a multiplier coupled to said glide information generator and said frequency information memory for multiplying said glide information output with the basic frequency information produced by said frequency information memory;

a frequency counter for receiving and cumulatively counting the multiplication results of said multiplier; and a musical tone waveshape memory for storing a desired musical tone waveshape which is read out by the output of said frequency counter.

2. An electronic musical instrument as defined in claim 1, further comprising means for establishing the frequency of said clock pulses individually for each of a plurality of keyboards.

3. An electronic musical instrument as defined in claim 1, wherein the output of said glide information generator is a gradually decreasing function.

4. An electronic musical instrument as defined in claim 1, wherein the output of said glide information generator is a gradually increasing function.

5. An electronic musical instrument as defined in claim 1, wherein said key address code generating means is operative in response to the depression of said key for producing an attack start signal, said glide controller receiving said attack start signal and being responsive thereto for controlling said counting operation of said counter to perform counting during only the time period of the attack portion of said musical tone waveshape.

6. An electronic musical instrument as defined in claim 5, further comprising means for establishing the frequency of said clock pulses individually for each of a plurality of keyboards.

7. An electronic musical instrument as defined in claim 5, wherein the output of said glide information generator is a graudally decreasing function.

8. An electronic musical instrument as defined in claim 5, wherein the output of said glide information generator is a gradually increasing function.

* * * * *